US007967697B2

(12) United States Patent
Jung

(10) Patent No.: US 7,967,697 B2
(45) Date of Patent: Jun. 28, 2011

(54) GOLF CLUB SHAFT AND METHOD OF FABRICATING THE SAME

(76) Inventor: Byung-chun Jung, Ulsan (KR)

( * ) Notice: Subject to any disclaimer, the term of this patent is extended or adjusted under 35 U.S.C. 154(b) by 91 days.

(21) Appl. No.: 11/883,613

(22) PCT Filed: Feb. 2, 2006

(86) PCT No.: PCT/KR2006/000375

§ 371 (c)(1),
(2), (4) Date: May 27, 2008

(87) PCT Pub. No.: WO2006/083122

PCT Pub. Date: Aug. 10, 2006

(65) Prior Publication Data

US 2008/0287212 A1 Nov. 20, 2008

(30) Foreign Application Priority Data

Feb. 3, 2005 (KR) ..... 20-2005-0003329
Apr. 26, 2005 (KR) ..... 20-2005-0011861
Oct. 4, 2005 (KR) ..... 10-2005-0092941

(51) Int. Cl.
*A63B 53/10* (2006.01)
*A63B 53/12* (2006.01)

(52) U.S. Cl. ..... 473/319; 473/320

(58) Field of Classification Search ..... 473/316–323
See application file for complete search history.

(56) References Cited

U.S. PATENT DOCUMENTS 5,018,735 A * 5/1991 Meredith et al. ..... 473/318
5,599,242 A * 2/1997 Solviche et al. ..... 473/318
5,743,811 A * 4/1998 Bird ..... 473/319
5,913,734 A * 6/1999 Tanaka ..... 473/320
6,155,932 A * 12/2000 Cabales et al. ..... 473/319
6,866,593 B1 * 3/2005 Cheng ..... 473/320
7,497,786 B2 * 3/2009 Cheng ..... 473/320

* cited by examiner

*Primary Examiner* — Stephen L. Blau
(74) *Attorney, Agent, or Firm* — Nelson Mullins Riley & Scarborough, LLP

(57) ABSTRACT

A precise impact and increased ball drive distance may be achieved due to an increase of elastic force and restoring force of a golf club shaft, when the golf club shaft includes: a first shell portion interiorly disposed in the golf club shaft; at least one elastic member disposed in a length direction on an exterior circumference of the first shell portion; and a second shell portion including carbon and enclosing the first shell portion and the at least one member.

12 Claims, 31 Drawing Sheets

GOLF CLUB SHAFT AND METHOD OF FABRICATING THE SAME

BACKGROUND OF THE INVENTION (a) Field of the Invention

The present invention relates to a golf club. More particularly, the present invention relates to a golf club shaft and a method of fabricating the same.

(b) Description of the Related Art

A golf club generally includes a club head for making impact with a golf ball, a club shaft combined with the club head, and a grip. A carbon shaft formed of a carbon fiber material may be taken as a typical example of the golf shaft, and it is extremely light-weight while showing sufficient strength and elastic force. Typically, a shaft functions to deliver the energy of swing to the ball, and a golfer feels the impact through the shaft. A backswing and a downswing are usually finished within a very short time, for example, within only one second, and the speed of the shaft may be over 150 km/hr during the swing. It is known that, during the swinging process, the golf shaft may experience a large amount of stress and show a large degree of torque. In addition, by an impact with the golf ball, the head is withdrawn with respect to the shaft, and thereafter the shaft resonates forward and rearward.

With a typical carbon shaft, a large degree of torque results during the downswing and at the moment of impact, and accordingly it is difficult to hit the ball exactly in a desired direction. In addition, since the carbon shaft has a relatively small restoring force, a golf ball drive distance is limited.

Further, in order to reduce torque and twist and to increase strength, a typical carbon shaft is fabricated by wrapping carbon fiber fabric to form a plurality of layers. However, in this case, the weight of the carbon shaft increases, resulting in deterioration of an impact feel.

The above information disclosed in this Background section is only for enhancement of understanding of the background of the invention and therefore it may contain information that does not form the prior art that is already known in this country to a person of ordinary skill in the art.

SUMMARY OF THE INVENTION

One motivation of the present invention is to provide a golf club shaft having reduced torque and twist such that a golfer may hit a golf ball in a precise manner so as to drive the ball in a desired direction.

Another motivation of the present invention is to provide a golf club shaft having enhanced restoring force such that precise impact may be achieved at the moment of impact so as to increase a ball drive distance.

Another motivation of the present invention is to provide a golf club shaft having an enhanced life.

An exemplary golf club shaft according to an embodiment of the present invention includes a first shell portion having at least one groove portion formed therein in a length direction of the shaft, at least one elastic member disposed at the at least one groove portion, and a second shell portion enclosing the first shell portion and the at least one elastic member.

The first shell portion may be formed by at least one layer of carbon fiber fabric.

The at least one elastic member may include at least one of metal and carbon having a predetermined elasticity.

When the elastic member includes metal, the metal may include steel or titanium as its main component.

The second shell portion may be formed by at least one layer of carbon fiber fabric.

A shrink film layer may be formed on an exterior circumference of the second shell portion.

The second shell portion may radially protrude by a predetermined height at a place where the elastic member is disposed in comparison with a place where the elastic member is not disposed.

The at least one elastic member may have a generally cylindrical shape and may include a plurality of elastic members of different diameters.

Another exemplary golf club shaft according to an embodiment of the present invention includes a first shell portion including carbon and being interiorly disposed in the shaft, at least one elastic member disposed in a length direction on an exterior circumference of the first shell portion, and a second shell portion including carbon and enclosing the first shell portion and the at least one elastic member.

A gap filling layer may be provided at an exterior surface of the at least one elastic member.

The gap filling layer may be formed of a carbon material.

An exemplary method of fabricating a golf club shaft according to an embodiment of the present invention includes forming a first shell portion at a circumference of a core having at least one groove portion in a length direction thereof, disposing an elastic member having a predetermined length at a location of the at least one groove portion on the first shell portion, forming a second shell portion exterior to the elastic member and the first shell portion, forming the first and second shell portions, and removing the core.

Such an exemplary method of fabricating a golf club shaft may further include wrapping a third shell portion at an exterior circumference of the second shell portion.

In addition, such an exemplary method of fabricating a golf club shaft may further include wrapping a shrink film at an exterior circumference of the second shell portion.

Another exemplary method of fabricating a golf club shaft according to an embodiment of the present invention includes wrapping a first shell portion around a core, disposing an elastic member having a predetermined length at an exterior circumference of the first shell portion, disposing a gap-filling sheet exterior to the elastic member, forming a second shell portion at an exterior circumference of the first shell portion, forming the first and second shell portions, and removing the core.

DETAILED DESCRIPTION OF THE EMBODIMENTS

An exemplary embodiment of the present invention will hereinafter be described in detail with reference to the accompanying drawings.

Figure 1:
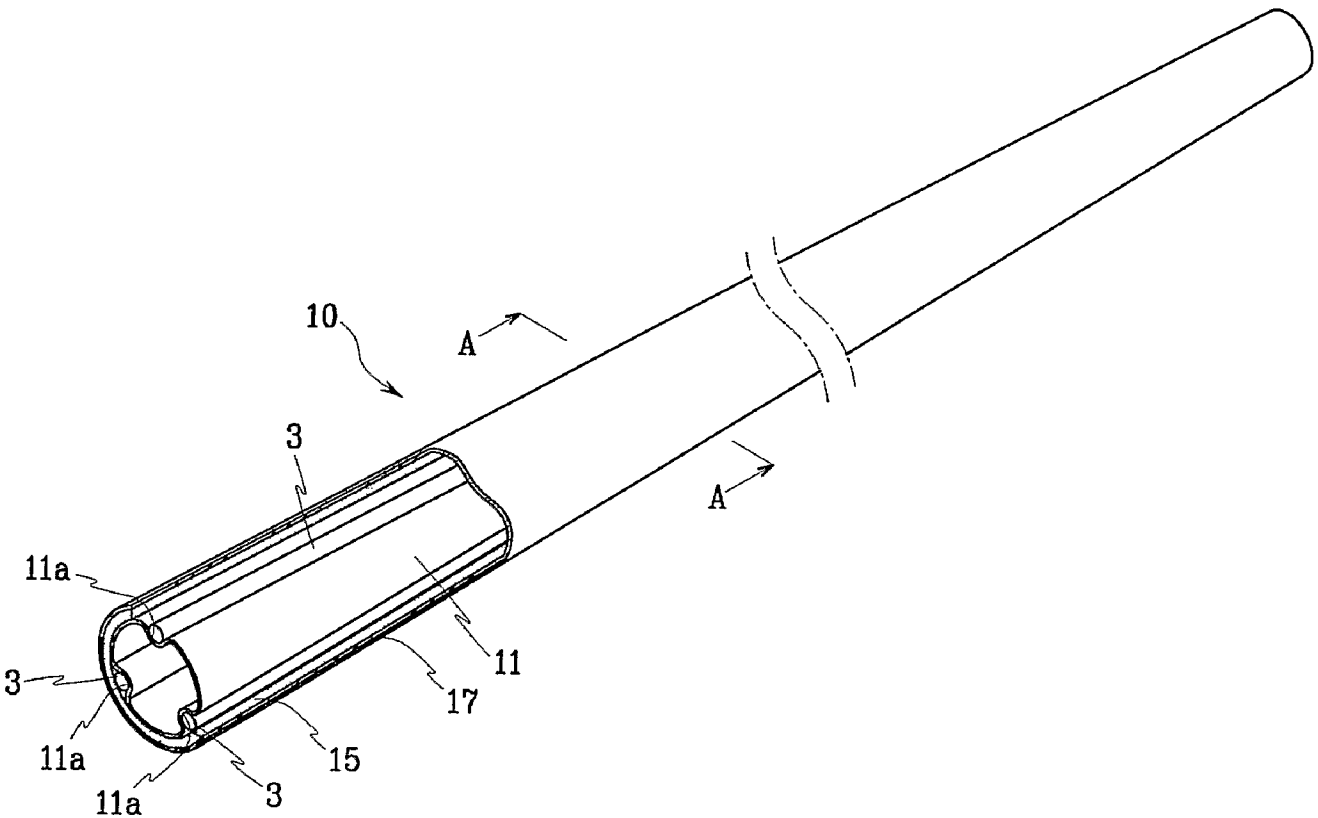
FIG. 1 is a partially cut-away perspective view of a golf club shaft according to a first exemplary embodiment of the present invention.

FIG. 1 is a partially cut-away perspective view of a golf club shaft 10 according to a first exemplary embodiment of the present invention.

The golf club shaft 10 according to the first exemplary embodiment of the present invention is formed as a carbon shaft, and it includes a first shell portion 11, a second shell portion 15, a third shell portion 17, and an elastic member 3.

The first shell portion 11 is disposed innermost among the first, second, and third shell portions 11, 15, and 17, and is formed of carbon fiber. The elastic member 3 is disposed on an exterior circumference of the first shell portion 11 in a length direction thereof. The second shell portion 15 covers the first shell portion 11 and the elastic member 3. The third shell portion 17 is disposed exterior to the second shell portion 15.

Figure 2:
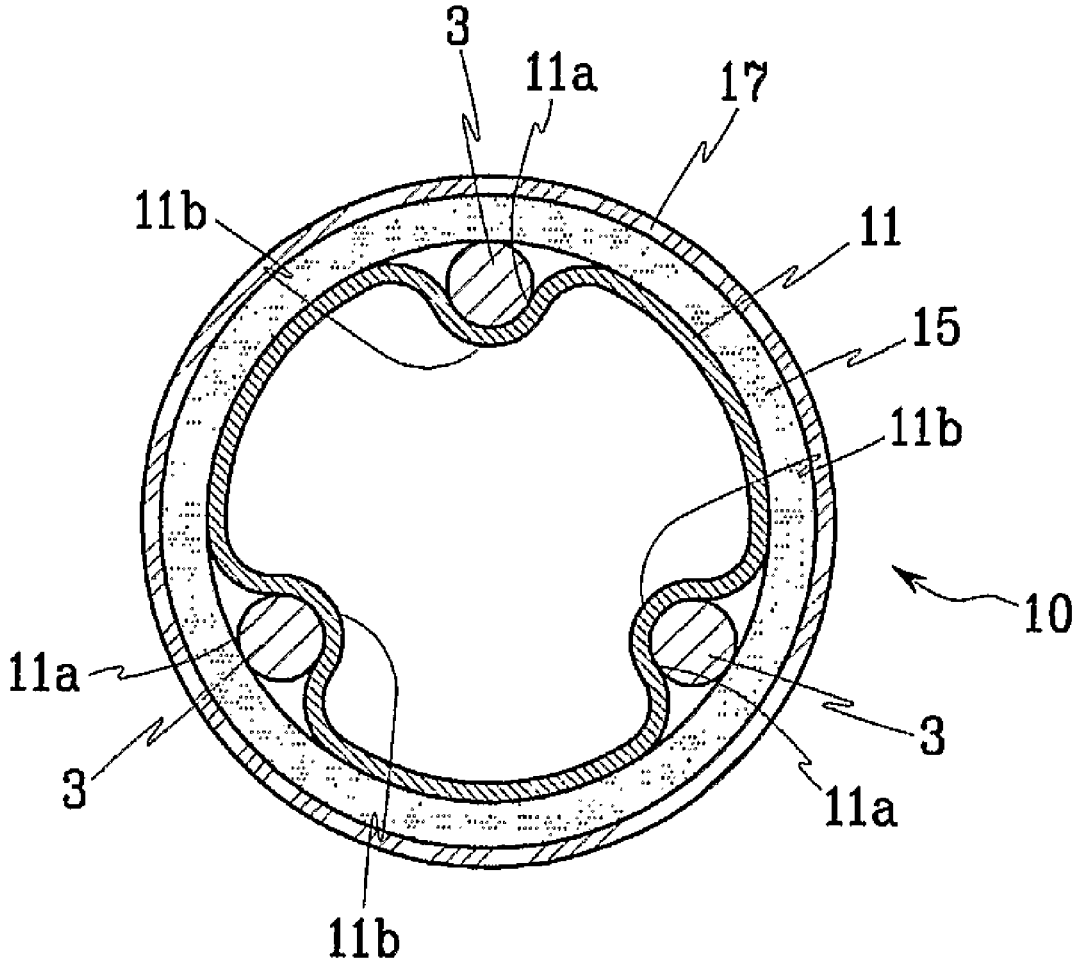
FIG. 2 is a cross-sectional view taken along the line A-A in FIG. 1.

At least one groove portion 11*a* is formed in a length direction at the first shell portion 11. FIG. 1 and FIG. 2 illustrate that three groove portions 11*a* are formed at the first shell portion 11, however, it should be understood that the scope of the present invention is not limited thereto.

In addition, a protruding portion 11*b* (refer to FIG. 2) protruding toward a center of the shaft 10 is formed at the first shell portion 11 at a side opposite to the groove portion 11*a* (i.e., a side of the first shell portion 11 facing the center of the shaft 10). The first shell portion 11 may be formed of a material obtained by hardening carbon fiber fabric. In addition, the first shell portion 11 is disposed innermost in the shaft 10, and it may be formed as a single layer or a plurality of layers. Further, it is illustrated that the first shell portion 11 forms a hollow interior space, but it should be understood that the scope of the present invention is not limited thereto.

Elastic members 3 having a predetermined length are disposed at the groove portion 11*a* of the first shell portion 11. The elastic members 3 are formed in a generally cylindrical shape that is thin and long. Such elastic members 3 may be formed of various materials. For example, the elastic members 3 may be formed of a carbon material, the same as the first shell portion 11. That is, the elastic member 3 may be formed of a carbon fiber material having high elasticity and ductility. For another example, the elastic members 3 may be formed of a metal (more specifically, aluminum or other materials including steel or titanium as a main component) having high elasticity and ductility. In addition, glass fiber having sufficient elasticity and ductility may also be used as the elastic member 3. A single elastic member 3 or a plurality of the elastic members 3 may be employed in the shaft 10, and when a plurality of the elastic members 3 are employed, they may be disposed with equal spacing therebetween.

In addition, the second shell portion 15 is disposed so as to exteriorly enclose the first shell portion 11 and the elastic member 3. The second shell portion 15 may be formed by wrapping and thermally hardening carbon fiber fabrics. According to the first exemplary embodiment of the present invention, the second shell portion 15 is formed in a generally circular cross-section. In addition, the second shell portion 15 may be formed in single or multiple carbon layers.

Further, according to the golf club shaft 10 according to the first exemplary embodiment of the present invention, the third shell portion 17 disposed exterior to the second shell portion 15 is formed with the same material as the second shell portion 15.

The elastic members 3 may be formed along a full length of the shaft 10, and they may also be formed along a partial length thereof.

The first shell portion 11 in the golf club shaft 10 according to the first exemplary embodiment of the present invention is in a simply circular shape, but it has undulations along its circumference such that elastic force and restoring force thereof may be enhanced. In addition, a material having high elastic force and restoring force is used as the elastic members 3 disposed in the groove portion 11*a* formed by the undulations, and the restoring force of the shaft 10 is thereby further enhanced. Therefore, using the golf club shaft 10 according to the first exemplary embodiment of the present invention, a precise impact may be realized and a ball drive distance may be increased. The elastic member 3 also provides reinforcement of the strength of the golf club shaft 10, so the golf club shaft 10 may have a longer life.

Hereinafter, a method of fabricating the golf club shaft 10 of a carbon material according to the first exemplary embodiment of the present invention will be described in detail. Although a method of fabrication a golf club shaft will be described in connection with the golf club shaft 10 according to the first exemplary embodiment of the present invention, it should be understood that the scope of the method of the present invention is limited thereto.

Figure 3:
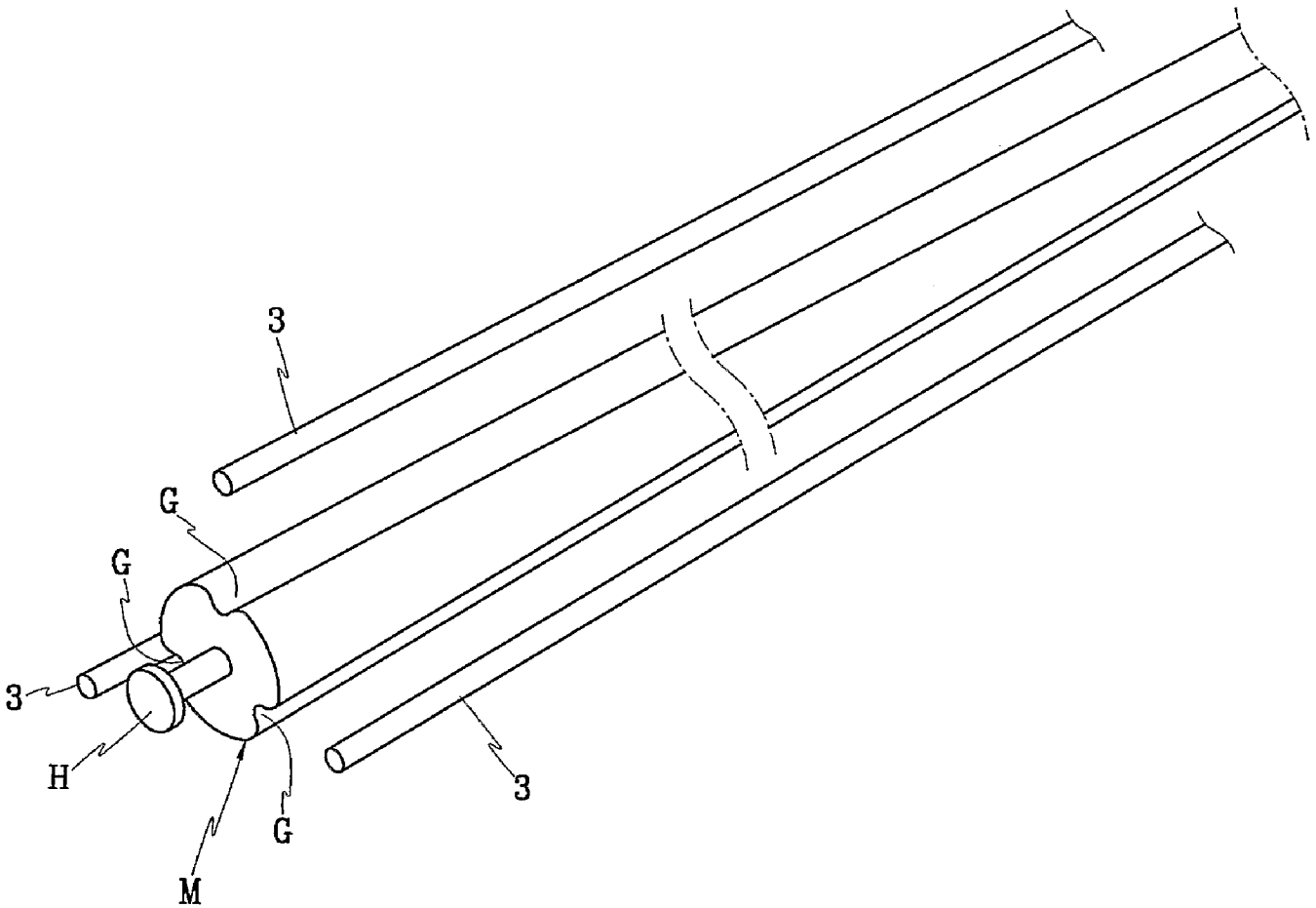
FIG. 3 is a perspective view showing a method of fabricating the golf club shaft according to the first exemplary embodiment of the present invention.
Figure 4:
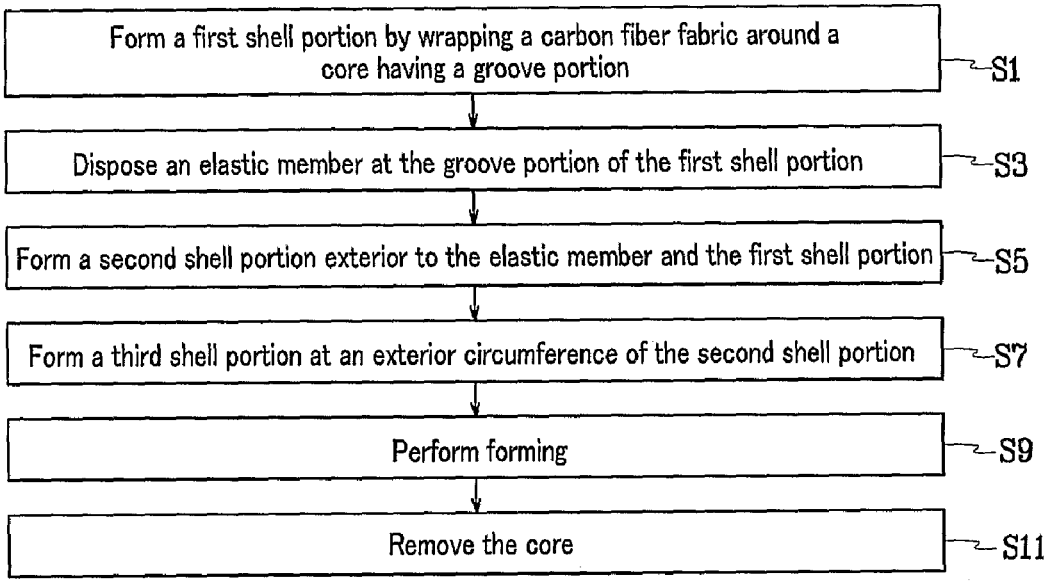
FIG. 4 is a flowchart showing a method of fabricating a golf club shaft according to the first exemplary embodiment of the present invention.

FIG. 3 is a perspective view showing a method of fabricating the golf club shaft according to the first exemplary embodiment of the present invention, and illustrates a core M and elastic members 3 used for fabricating the shaft 10. In addition, FIG. 4 is a flowchart showing the method of fabricating the golf club shaft according to the first exemplary embodiment of the present invention.

Firstly at step S1, the first shell portion 11 is formed by wrapping carbon fiber fabrics of desired shapes around a core M having three groove portions G in a length direction.

Then at step S3, at positions of the groove portions G, the elastic members 3 are disposed on the exterior circumference of the first shell portion 11, and they are inserted in the groove portions G. At this time, three groove portions 11*a* are formed at the first shell portion 11 in conformity with the shape of the core M.

Subsequently at step S5, the second shell portion 15 is formed by simultaneously wrapping the elastic members 3 and the first shell portion 11 with another carbon fiber fabric that is the same as or different from the first shell portion 11. At this time, the second shell portion 15 is formed in a generally circular exterior shape.

Subsequently at step S7, the third shell portion 17 is formed by wrapping another carbon fiber fabric round the exterior circumference of the second shell portion 15. Such a third shell portion 17 might not be employed, depending on design requirements.

Subsequently at step S9, the form of the core M wrapped by the carbon fiber fabrics and disposed with the elastic members therebetween is thermally fixed in a furnace. At this step, an epoxy contained in the carbon fiber fabrics is thermally melted and then hardened, and the first, second, and third shell portions 11, 15, and 17 are adhered to each other so as to finally produce a firm shaft 10.

Subsequently at step S11, the core M is separated from such formed shaft 10. The core M may be provided with a catch H such that the core M may be easily separated.

An operation and effect of the golf club shaft according to an exemplary embodiment of the present invention will be described in detail with reference to FIG. 5.

Figure 5:
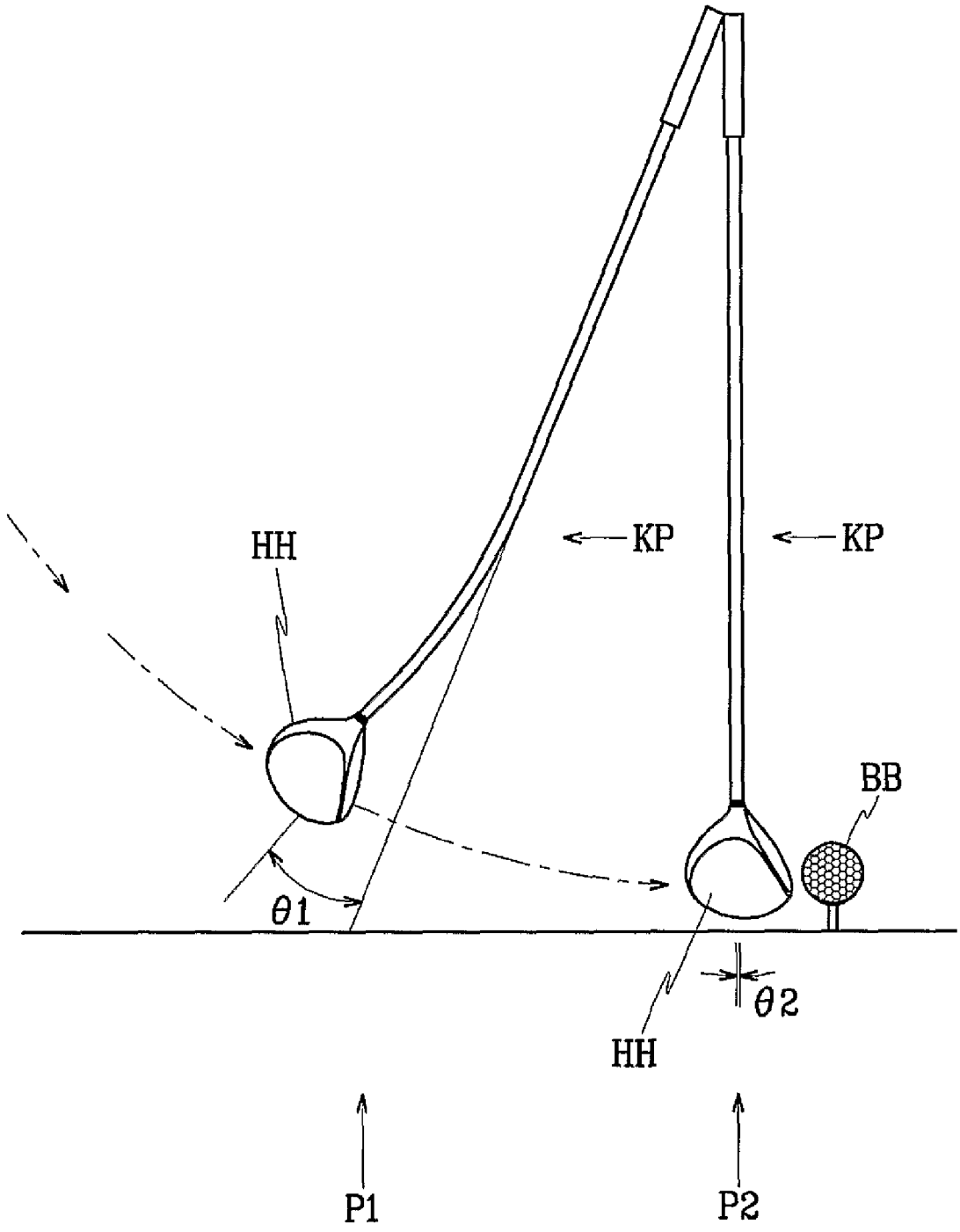
FIG. 5 illustrates an operation of an effect of the golf club shaft according to the first exemplary embodiment of the present invention.

FIG. 5 illustrates a downswing and an impact moment, where P1 indicates a moment during the downswing, and P2 indicates the moment of impact of the head HH on the ball BB. A degree of torque of the shaft is illustrated in FIG. 5. In addition, the symbol KP denotes a typical kick-point (inflection point of a profile of the shaft) of a general shaft. Such a kick-point may be formed at multiple points on the shaft with predetermined spacing therebetween, although only one kick-point is illustrated in FIG. 5.

During the downswing, a torque may be caused at the shaft 10 by a hard initial acceleration. For example, at the moment of P1, the torque may be formed to a degree θ1 with respect to the kick-point KP. However, due to the restoring force of the elastic members 3 and the restoring force formed by the groove portions 11*a* and protruding portions 11*b* of the first shell portion 11, the restoring force of the shaft 10 according to an embodiment of the present invention is enhanced from that of a conventional golf club shaft of a carbon material. By such an enhanced restoring force of the shaft, the torque degree θ1 of the shaft diminishes during the swing, and at the moment of the impact of the head HH on the ball BB, the torque degree θ2 becomes minimal such that a precise impact may become possible.

Therefore, a golfer may hit the ball accurately and sent it in the desired direction. Furthermore, since the torque degree reduces during the swing, the ball distance is also enhanced by the aid of a so-called snap effect. In addition, since the elastic force of the elastic member reduces shocks that are delivered to shoulders of the golfer, the golfer may not easily feel fatigue and injuries may be prevented. In addition, the elastic member 3 reinforces the strength of the shaft, and therefore the durability of the shaft is increased.

Figure 6:
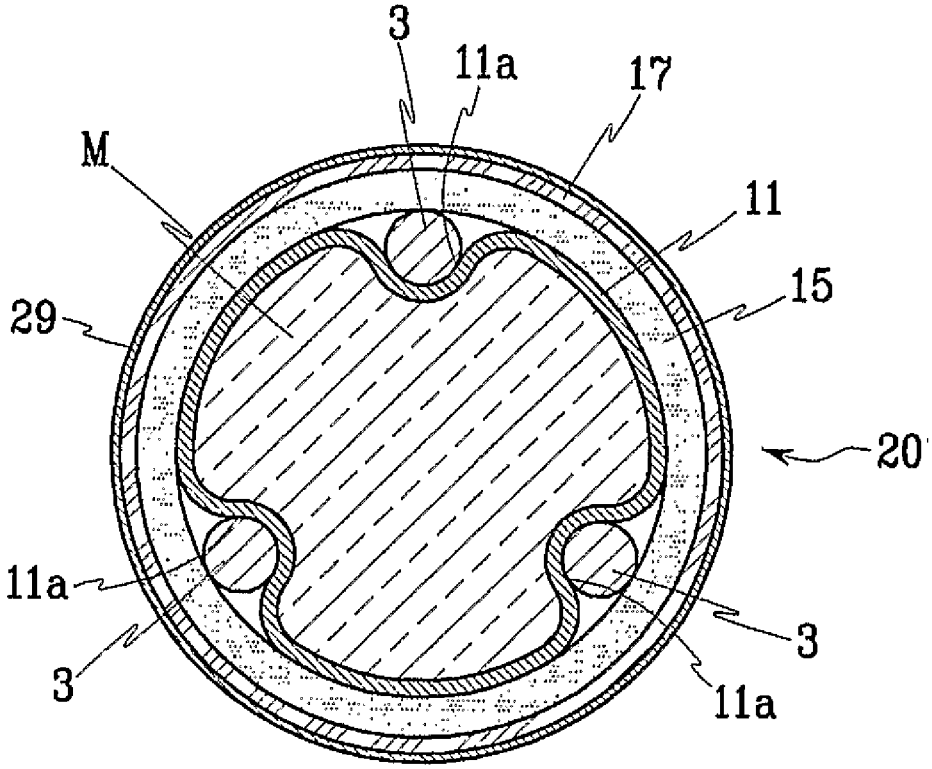
FIG. 6 is a cross-sectional view of a golf club shaft according to a second exemplary embodiment of the present invention, the cross-section being taken perpendicular to the length direction of the shaft.
Figure 7:
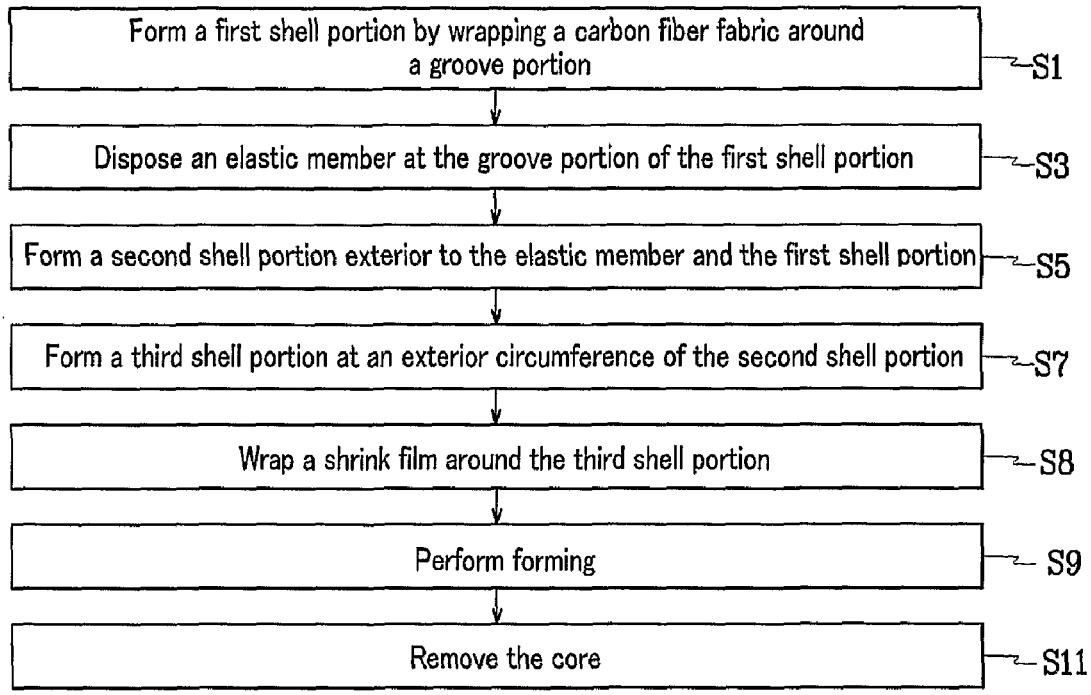
FIG. 7 is a flowchart showing a method of fabricating a golf club shaft according to the second exemplary embodiment of the present invention.

FIG. 6 is a cross-sectional view of a golf club shaft 20 according to a second exemplary embodiment of the present invention, which corresponds to FIG. 2. FIG. 7 is a flowchart showing a method of fabricating a golf club shaft 20 according to the second exemplary embodiment of the present invention.

The following description of a golf club shaft 20 according to the second exemplary embodiment of the present invention and a fabricating method is focused on differences from the golf club shaft 10 according to the first exemplary embodiment and a fabricating method thereof.

According to the golf club shaft 20 of the second exemplary embodiment of the present invention in comparison with the golf club shaft 10 of the first exemplary embodiment, a shrink film is wrapped along the exterior circumference of the third shell portion 17 disposed most exterior among the first, second, and third shell portions 11, 15, and 17, and thereby a shrink film layer 29 is formed (refer to step S8 in FIG. 7). The shrink film layer 29 helps the carbon fiber fabrics to keep their shape during the forming process. A film, such as a PE tape, that is shrinkable by application of heat may be used as the shrink film layer 29.

According to such a golf club shaft according to the second exemplary embodiment of the present invention and a fabricating method thereof, a shrink film layer is formed exterior to the carbon fiber fabrics wrapped in order to form the shaft 20, so the carbon fiber fabrics may keep their shapes such that a final product may have enhanced quality.

The golf club shaft according to the second exemplary embodiment and a fabricating method thereof differ from the golf club shaft according to the first exemplary embodiment and a fabricating method thereof in that the shrink film layer 29 is disposed at an outermost exterior circumference of the shaft. Other features of the golf club shaft according to the second exemplary embodiment of the present invention and a fabricating method thereof are similar to those of the golf club shaft 10 according to the first exemplary embodiment of the present invention and a fabricating method thereof, so for a description thereof they may be referred to.

Figure 8:
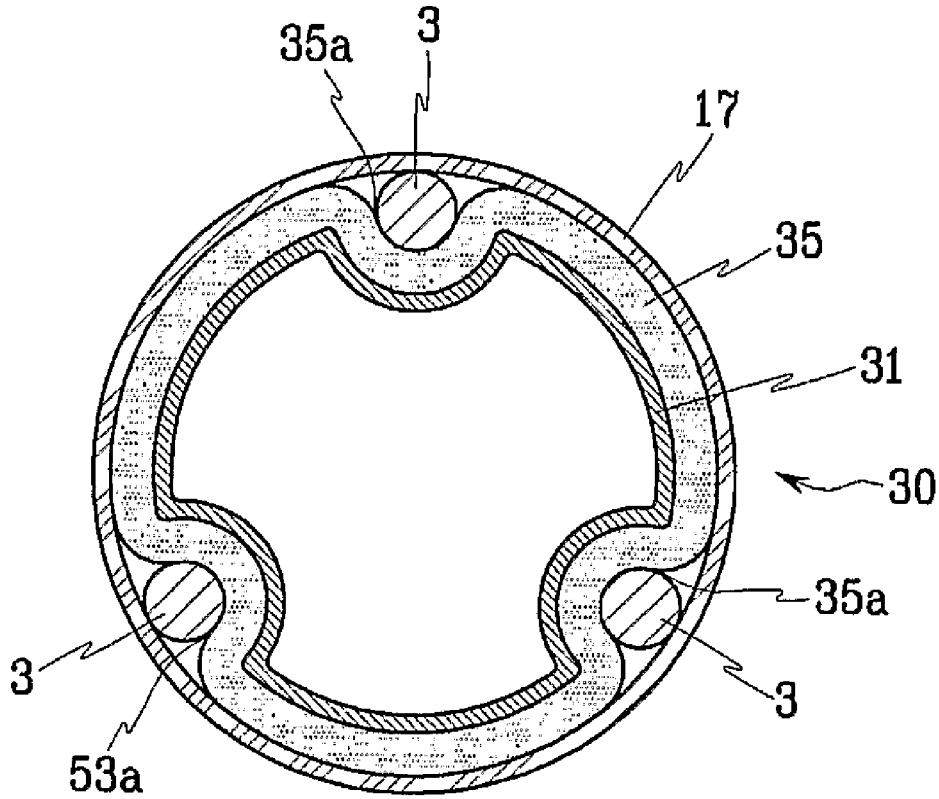
FIG. 8 is a cross-sectional view of a golf club shaft according to a third exemplary embodiment of the present invention, the cross-section being taken perpendicular to the length direction of the shaft.
Figure 9:
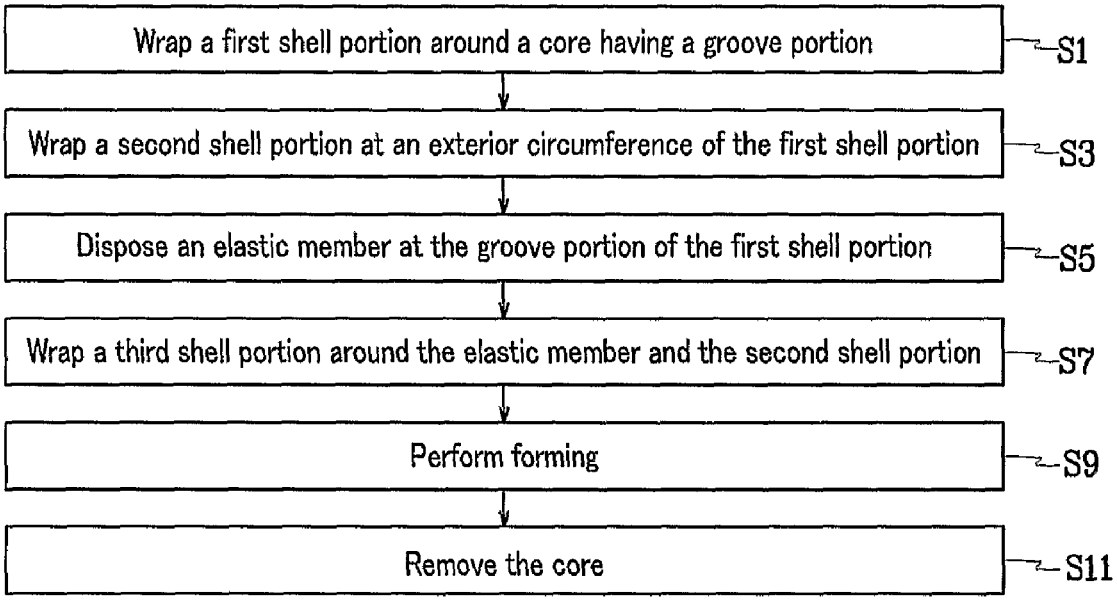
FIG. 9 is a flowchart showing a method of fabricating a golf club shaft according to the third exemplary embodiment of the present invention.

FIG. 8 is a cross-sectional view of a golf club shaft 30 according to a third exemplary embodiment of the present invention, the cross-section being taken perpendicular to the length direction of the shaft 30. FIG. 9 is a flowchart showing a method of fabricating the golf club shaft 30 according to the third exemplary embodiment of the present invention.

The following description of a golf club shaft 30 according to the third exemplary embodiment of the present invention and a fabricating method thereof is focused on differences from the golf club shaft 10 according to the first exemplary embodiment and a fabricating method thereof.

In the above-described first exemplary embodiment, the elastic members 3 are disposed at positions of the groove portions 11*a* on the exterior surface of the first shell portion 11. According to the third exemplary embodiment of the present invention, a second shell portion 35 is disposed on an exterior circumference of a first shell portion 31, and the elastic members 3 are disposed in a length direction at groove portions 35*a* formed at an exterior circumference of the second shell portion 35. That is, referring to FIG. 9, the golf club shaft 30 according to the present invention is fabricated in a manner in which, in comparison with the first exemplary embodiment, the steps S3 and S5 are performed in an opposite order.

According to the golf club shaft 30 according to the third exemplary embodiment of the present invention in comparison with the golf club shaft 10 according to the first exemplary embodiment, the restoring force of the golf club shaft 30 may be further enhanced due to less twisting of the shaft since the elastic members 3 are disposed at positions farther from the center of the shaft.

Such a third exemplary embodiment of the present invention is an example showing that a variety of variations may be applied to the first exemplary embodiment.

Figure 10:
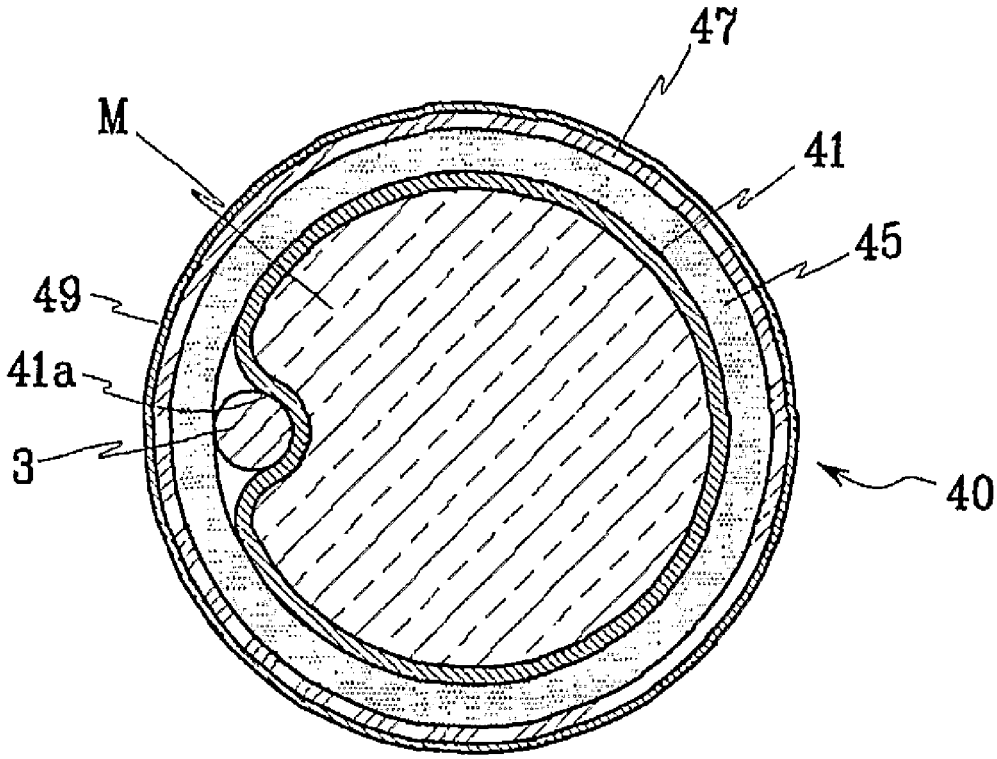
FIG. 10, FIG. 11, FIG. 12, FIG. 13, and FIG. 14 are respectively cross-sectional views of golf club shafts according to fourth, fifth, sixth, seventh, and eighth exemplary embodiments of the present invention, the cross-section being taken perpendicular to the length direction of the shaft.

FIG. 10 is a cross-sectional view of a golf club shaft 40 according to a fourth exemplary embodiment of the present invention, which corresponds to FIG. 2.

The following description of a golf club shaft 40 according to the fourth exemplary embodiment of the present invention is focused on differences from the golf club shaft 10 according to the first exemplary embodiment.

In the above-described first exemplary embodiment, three elastic members 3 are disposed in the length direction of the shaft 10. According to the fourth exemplary embodiment of the present invention, a single elastic member 3 is disposed in the length direction of the shaft 40. Therefore, a single groove portion 41*a* is provided at a first shell portion 41. Second and third shell portions 45 and 47 of the fourth embodiment are the same as the second and third shell portions 15 and 17 of the first exemplary embodiment. According to the fourth embodiment, a shrink film layer 49 is formed exterior to the third shell portion 47, the same as in the first exemplary embodiment.

Such a fourth exemplary embodiment of the present invention is another example showing that a variety of variations may be applied to the first exemplary embodiment.

Figure 11:
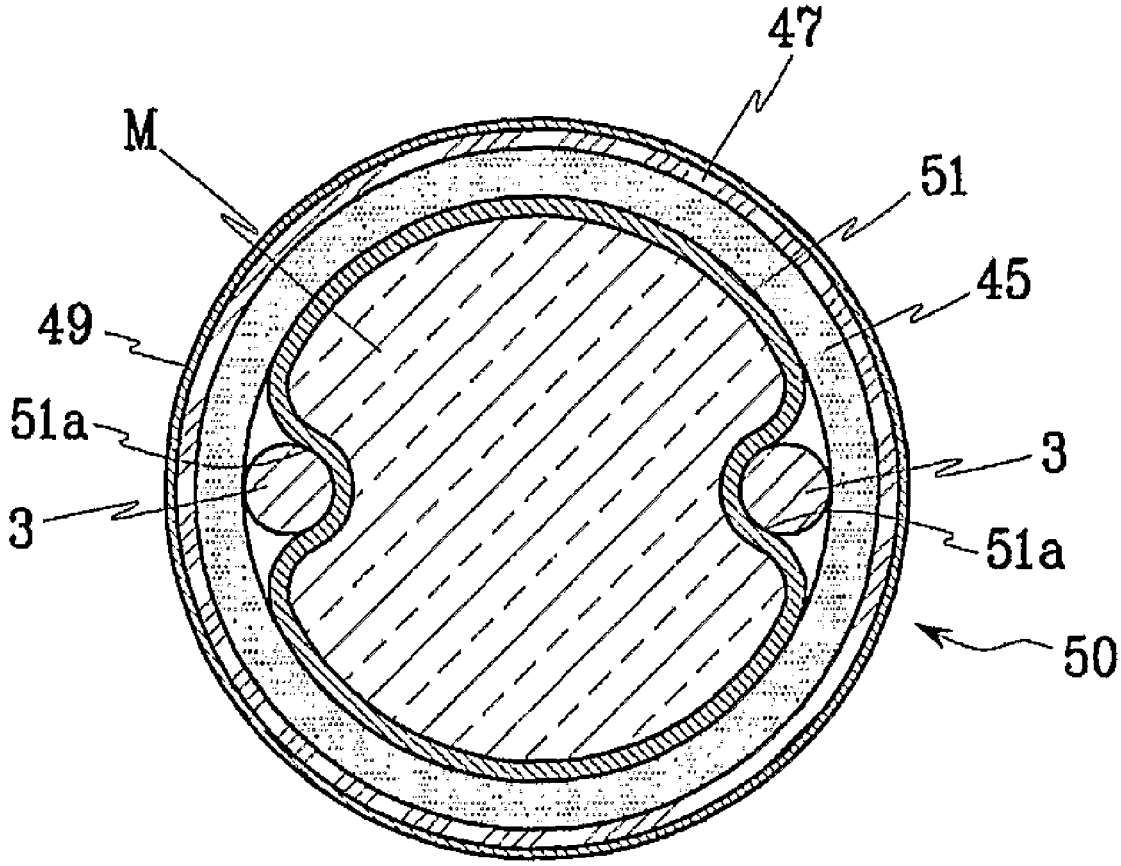
Figure 12:
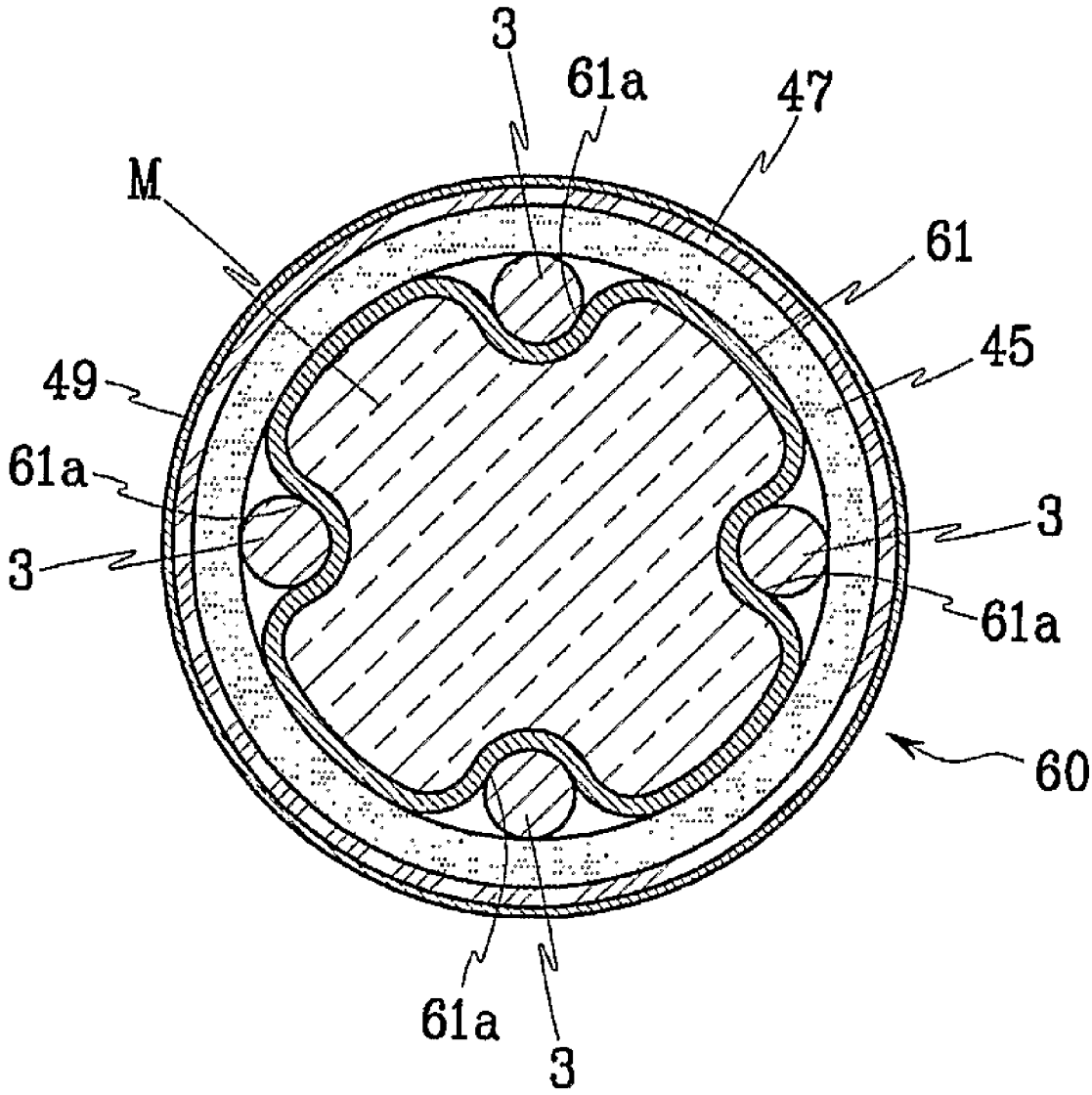
Figure 13:
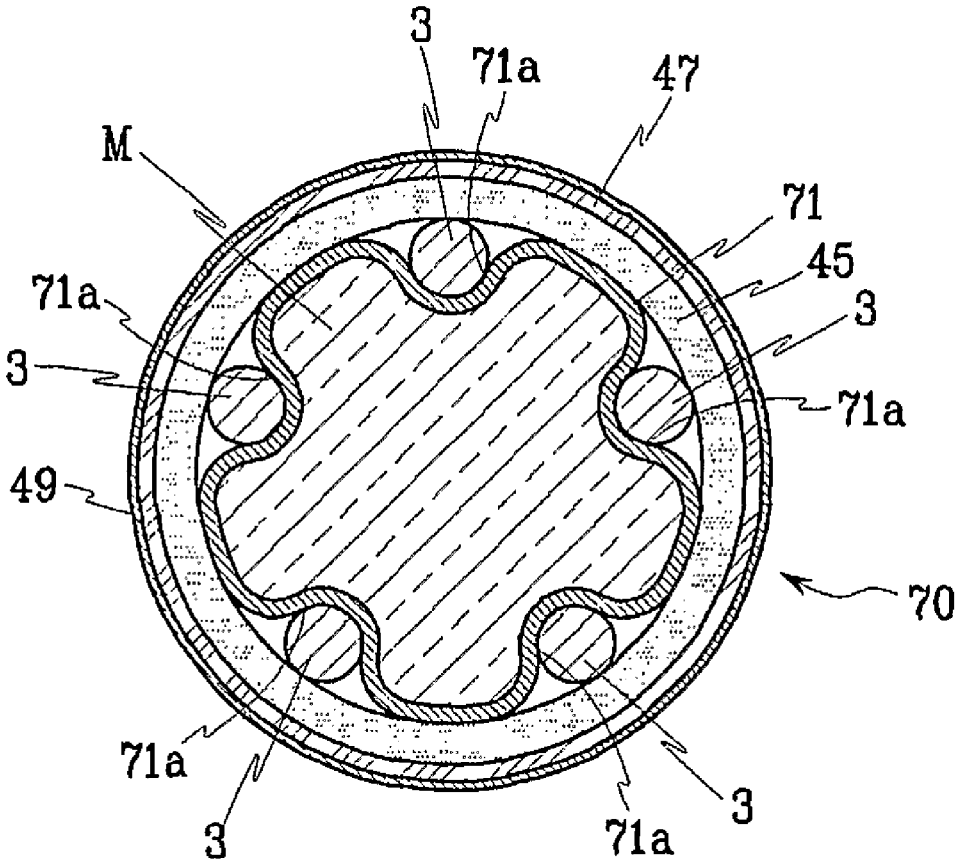

In addition, FIG. 11, FIG. 12, and FIG. 13 are respectively cross-sectional views of golf club shafts 50, 60, and 70 according to fifth, sixth, and seventh exemplary embodiments of the present invention, which correspond to FIG. 2. The drawings show that the number of elastic members 3 may be varied.

The following description of golf club shafts 50, 60, and 70 according to the fifth, sixth, and seventh exemplary embodiments are focused on differences from the golf club shaft 40 according to the fourth exemplary embodiment.

In the first exemplary embodiment, three elastic members 3 are employed, and in the fourth exemplary embodiment, one elastic member 3 is employed. In comparison, two, four, and five elastic members 3 are respectively employed according to the fifth, sixth, and seventh exemplary embodiments of the present invention. Therefore, two, four, and five groove portions 51*a*, 61*a*, and 71*a* are respectively provided at first shell portions 51, 61, and 71 according to the fifth, sixth, and seventh exemplary embodiments.

Such fifth, sixth, and seventh exemplary embodiments of the present invention indicate that a variety of embodiments may be obtained within the spirit of the present invention. It is notable that more than five elastic members 3 may be employed depending on cases.

Figure 14:
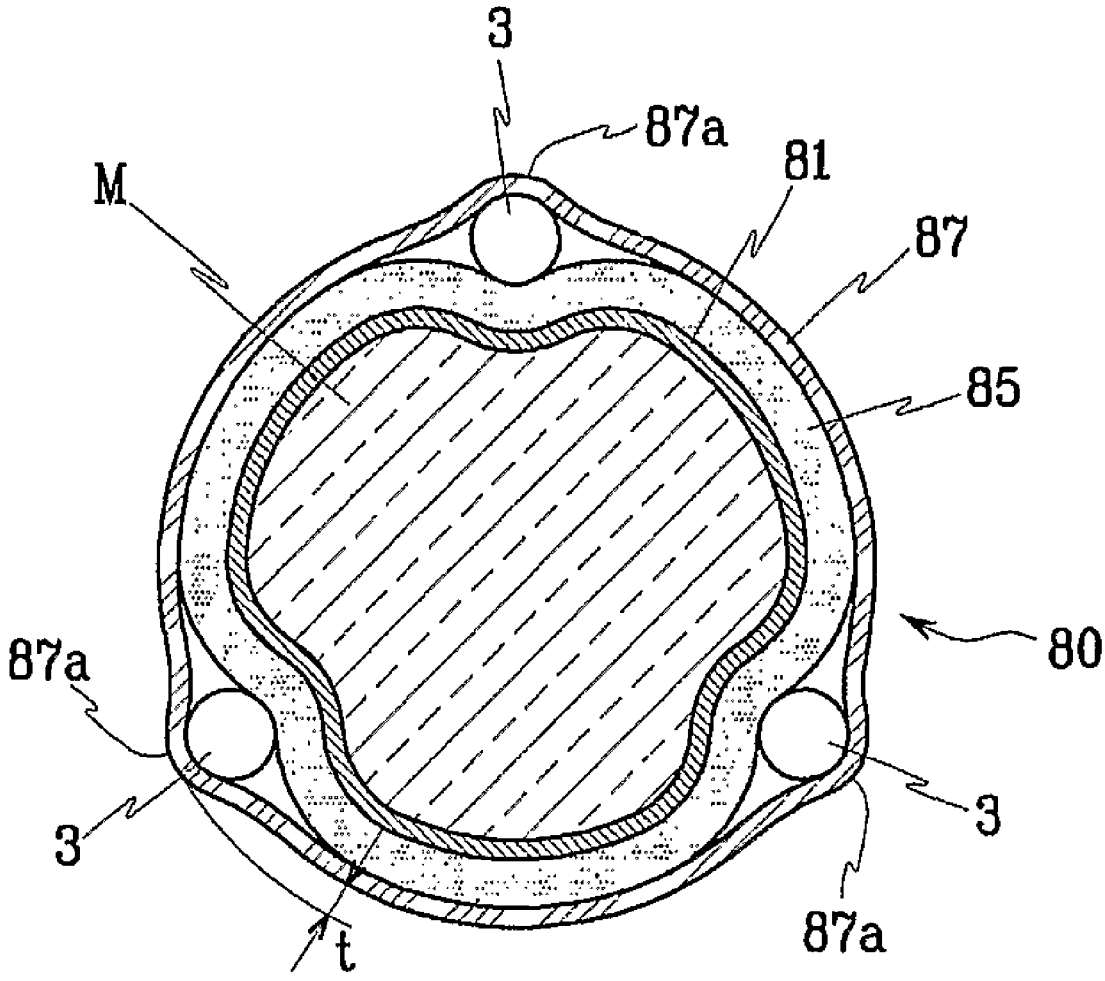

FIG. 14 is a cross-sectional view of a golf club shaft 80 according to an eighth exemplary embodiment of the present invention, and it shows an exemplary variation of the golf club shaft 30 (refer to FIG. 8) according to the third exemplary embodiment.

The same as the golf club shafts according to the above-described exemplary embodiments, the golf club shaft 80 according to present embodiment includes first, second, and third shell portions 81, 85, and 87, wherein the first and second shell portions 81 and 85 have undulations such that elastic members 3 may be disposed. As shown in FIG. 14, elastic members 3 are disposed in the golf club shaft 80 such that an exterior surface of the golf club shaft 80 may exteriorly protrude. That is, protruding portions 87*a* that exteriorly protrude are formed by the elastic members 3 in the golf club shaft 80 according to the eighth exemplary embodiment of the present invention. The protruding portions 87*a* protrude by a thickness t with respect to portions where the elastic members 3 are not disposed. In addition, such protruding portions 87*a* are formed with a predetermined length along the length direction of the shaft 80.

Such an eighth exemplary embodiment of the present invention indicates that a variety of embodiments may be obtained within the spirit of the present invention.

Figure 15:
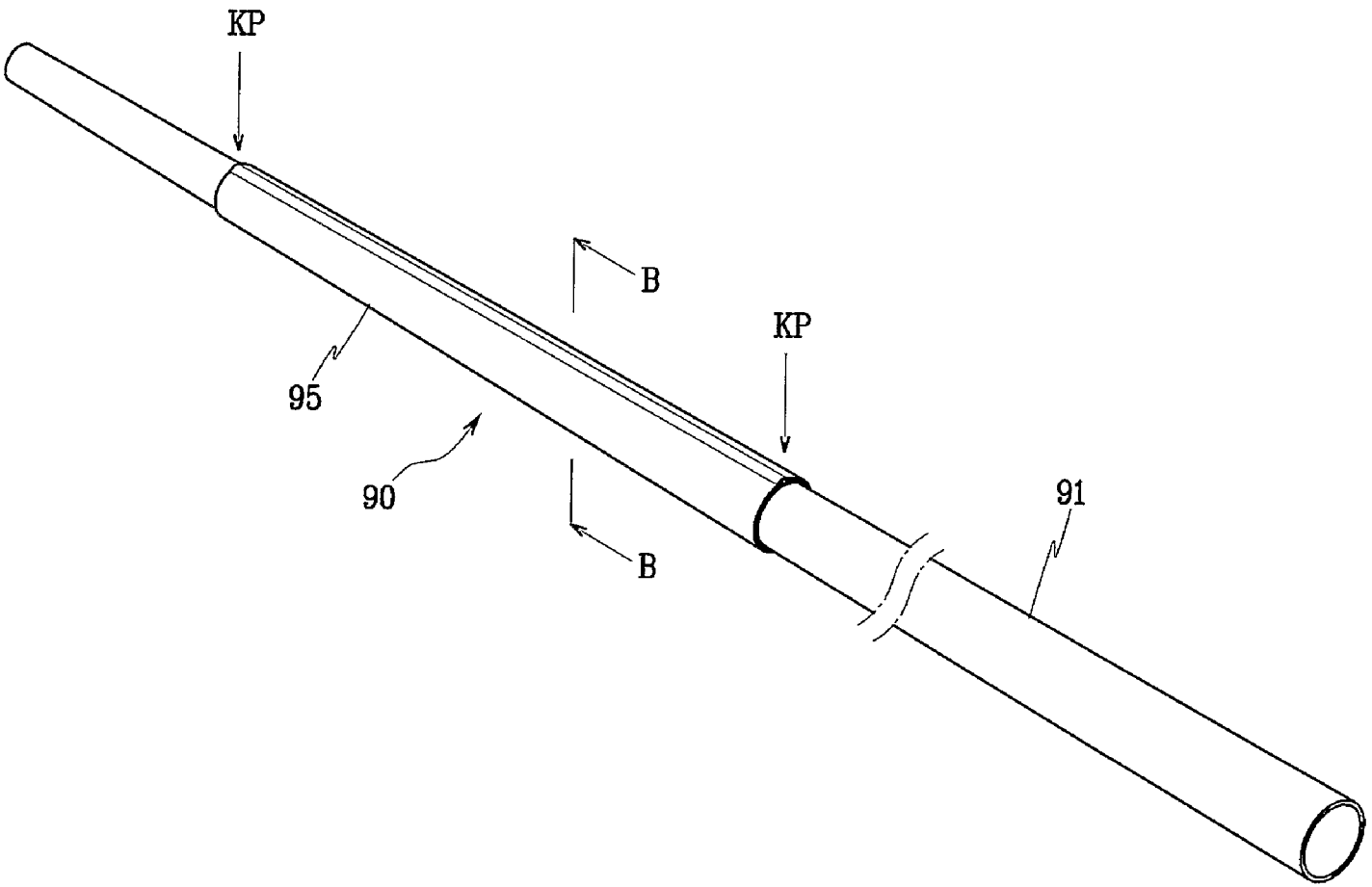
FIG. 15 is a perspective view of a golf club shaft according to a ninth exemplary embodiment of the present invention.
Figure 16:
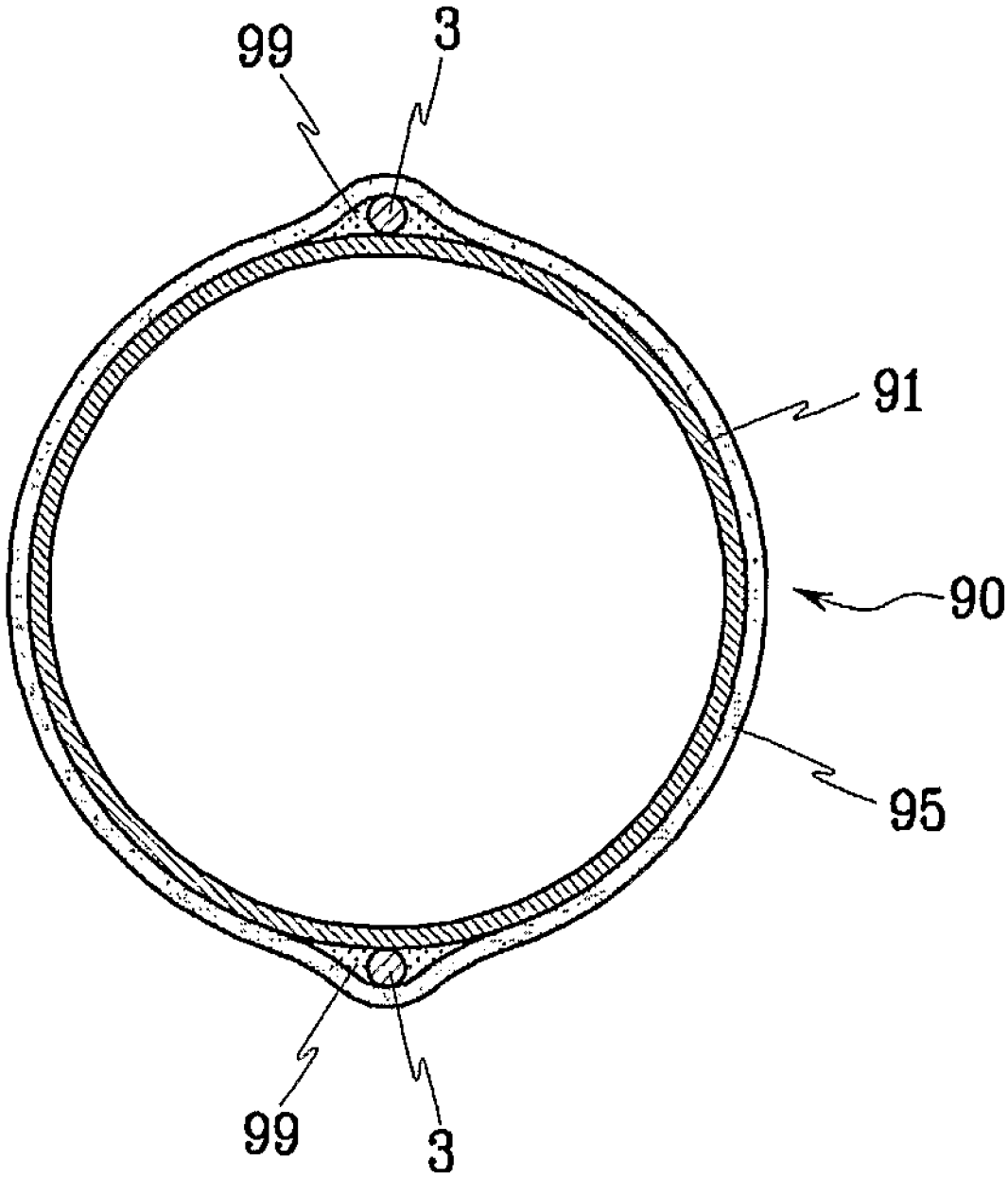
FIG. 16 is a cross-sectional view taken along the line B-B in FIG. 15.
Figure 17:
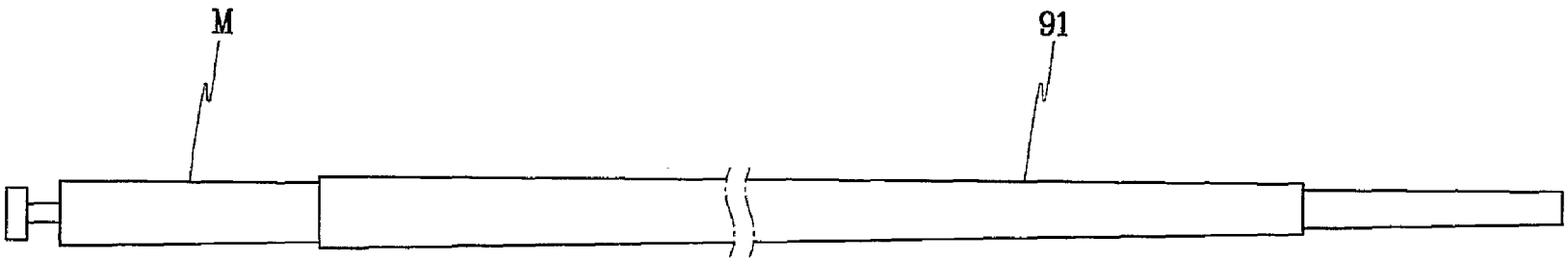
FIG. 17 shows a step in a method of fabricating a golf club shaft according to the ninth exemplary embodiment of the present invention.

FIG. 15 is a perspective view of a golf club shaft 90 according to a ninth exemplary embodiment of the present invention and FIG. 16 is a cross-sectional view taken along the line B-B in FIG. 15.

The following description of the golf club shaft 90 according to the ninth exemplary embodiment of the present invention and a fabricating method thereof is focused on differences from the golf club shaft 10 according to the first exemplary embodiment of the present invention and a fabricating method thereof.

According to the shaft 90 of the ninth exemplary embodiment of the present invention, a first shell portion 91 disposed innermost therein has a circular cross-section, the same as a conventional carbon shaft. However, a second shell portion 95 wrapping around an exterior circumference of the first shell portion 91 is formed in a shape in which an exterior circumference thereof protrudes outward over a predetermined range. In addition, in the shaft 90 according to the ninth exemplary embodiment of the present invention, a gap filling layer 99 is disposed around the elastic members 3.

That is, according to the ninth exemplary embodiment of the present invention, at least one elastic member 3 is disposed along a length direction at the exterior circumference of the first shell portion 91 that is generally in a circular shape. In addition, the gap filling layer 99 is formed at an area where the elastic members 3 are disposed (refer to FIG. 16 and FIG. 21). Further, the first shell portion 91 and the elastic member 3 are enclosed by the second shell portion 95 (refer to FIGS. 15, 16, and 18-21). While the second shell portion 95 encloses the elastic members 3, the gap filling layer 99 fills a space that can be formed between the elastic members 3 and the first shell portion 91.

As has been described in connection with other embodiments of the present invention, the first and second shell portions 91 and 95 may be formed by thermally forming carbon fiber fabrics. In addition, the first and second shell portions 1 and 5 may be formed as a single layer or may be formed as a plurality of layers, respectively.

In such a ninth exemplary embodiment of the present invention, an area of the elastic members 3 and the gap filling layer 99 may range from a golf club grip to a kick-point KP. Alternatively, when a plurality of kick-points KP are provided in the shaft, the elastic members 3 and the gap filling layer 99 may be confined between the kick-points KP (refer to FIG. 15). That is, the elastic members 3 may be formed in a partial lengthwise range of the shaft 90.

Hereinafter, a method for fabricating the golf club shaft 90 according to the ninth exemplary embodiment of the present invention will be described in further detail with reference to FIG. 17 to FIG. 22.

A core M of a generally circular cross-section is of a generally long and thin shape and is tapered such that a diameter thereof varies along its length direction. At step S1 carbon fiber fabrics are wrapped around such a core M so as to form the first shell portion 91 (refer to FIG. 17). A typical core used for fabricating a conventional golf club shaft may be used as the core M.

Figure 18:
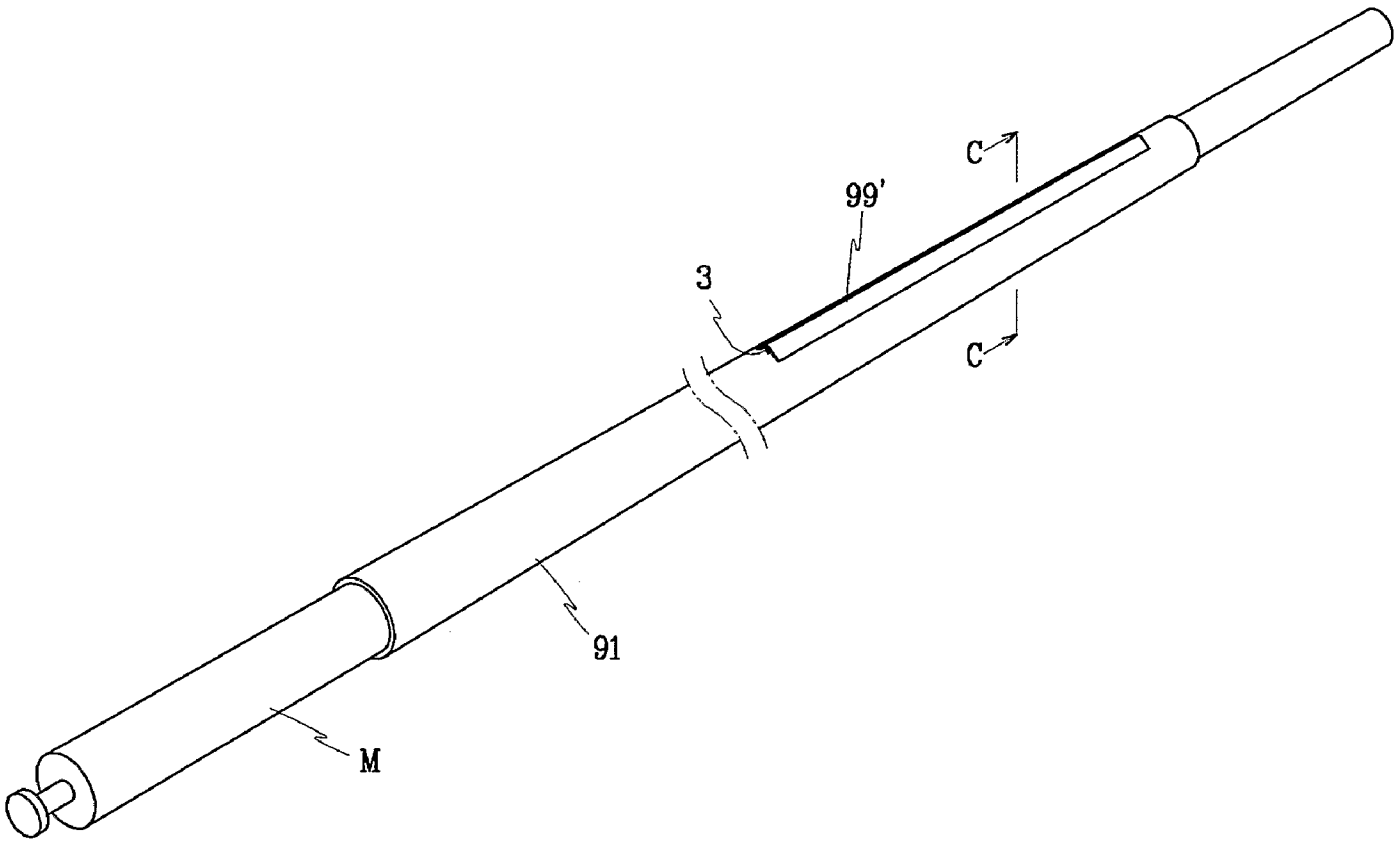
FIG. 18 is a perspective view showing a step subsequent to that of FIG. 17 in a method of fabricating a golf club shaft according to the ninth exemplary embodiment of the present invention.
Figure 19:
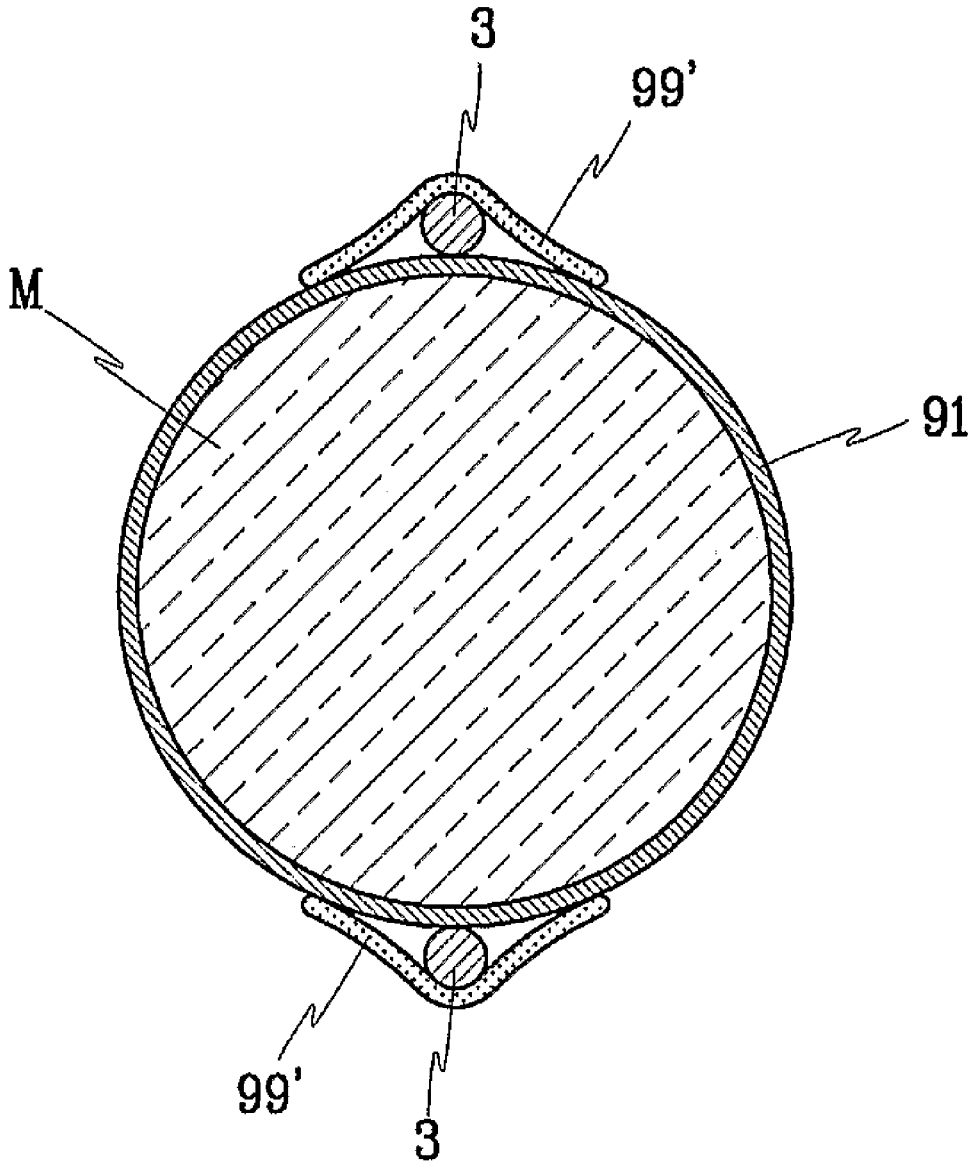
FIG. 19 is a cross-sectional view taken along the line C-C in FIG. 18.

Subsequently at step S3, the elastic members 3 are disposed with equal spacing therebetween around the exterior circumference of the first shell portion 91 (refer to FIG. 18). The elastic member 3 of the present invention may be the same as one that has been described in connection with the above-described various exemplary embodiments.

Subsequently at step S5, a gap filling sheet 99' is disposed exterior to the elastic member 3 (refer to FIG. 18). The gap filling sheet 99' is formed as a material such as glass fiber or carbon fiber that melts with application of heat to fill the space between the first and second shell portions 91 and 95. Due to such a gap filling sheet 99', a space (or a gap) that may occur between the first and second shell portions 91 and 95 by the elastic members 3 may be filled, and therefore the shaft 90 may be produced with more homogeneity and strength.

Figure 20:
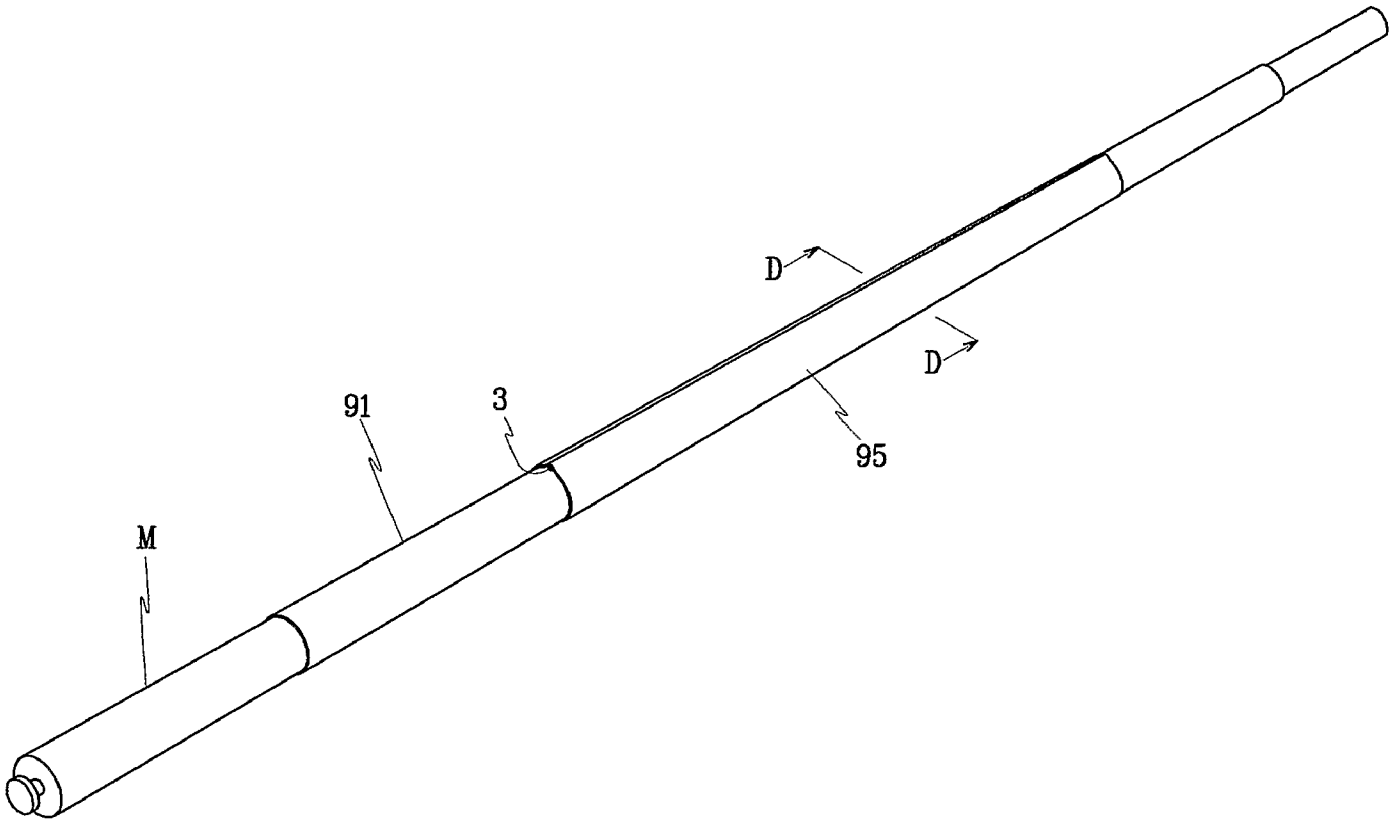
FIG. 20 is a perspective view showing a step subsequent to that of FIG. 18 in a method of fabricating a golf club shaft according to the ninth exemplary embodiment of the present invention.
Figure 21:
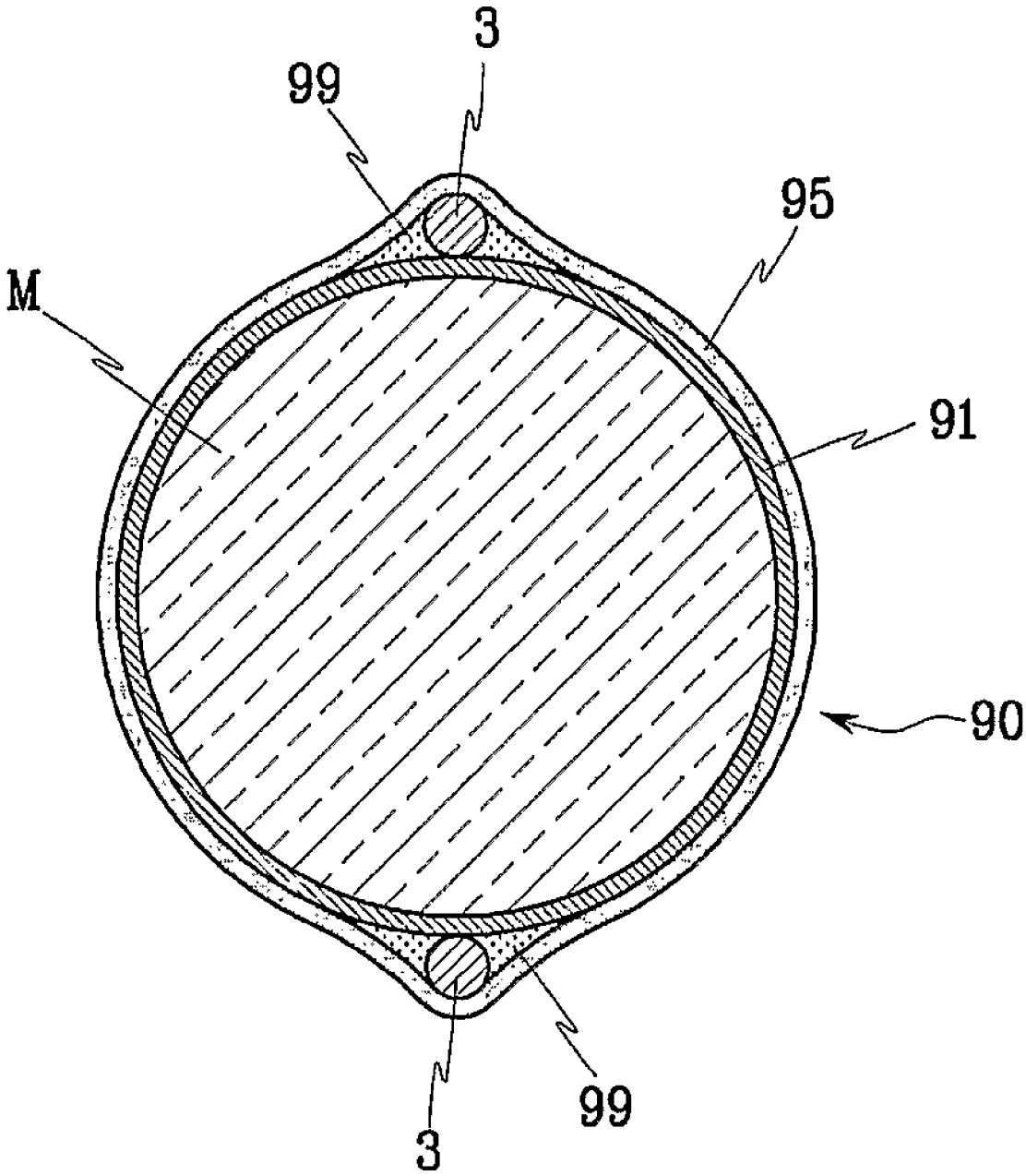
FIG. 21 is a cross-sectional view taken along the line D-D in FIG. 20.
Figure 22:
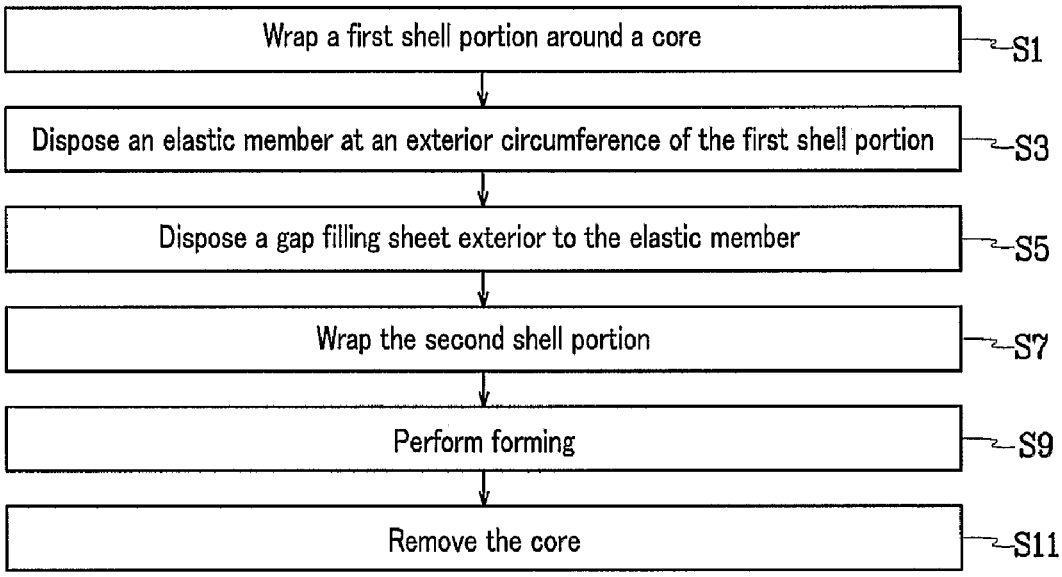
FIG. 22 is a flowchart showing a method of fabricating a golf club shaft according to the ninth exemplary embodiment of the present invention.

After disposing the gap filling sheet 99', the gap filling sheet 99' and the first shell portion 91 are wrapped at step S7 by another carbon fiber fabric so as to form the second shell portion 95 (refer to FIG. 20).

Subsequently at step S9, the form of the core M wrapped with the carbon fiber fabrics is thermally fixed in a furnace. At this step, an adhesive resin contained in the carbon fiber fabrics is thermally melted and then hardened, and the gap filling sheet 99' is also melted and hardened. During the course, the first and second shell portions 91 and 95 are adhered with each other without leaving any space therebetween due to the gap filling layer 99, and thus a firm shaft 90 may be produced (refer to FIG. 21).

Subsequently at step S11, the core M is separated from such formed shaft 90. Then, the shaft 90 having a protruding central region as shown in FIG. 15 is obtained.

FIG. 23, FIG. 24, FIG. 25, and FIG. 26, are respectively cross-sectional views of golf club shafts 100, 110, 120, and 130 according to tenth, eleventh, twelfth, and thirteenth exemplary embodiments of the present invention, and they show that the number of the elastic members 3 may vary within the spirit of the present invention.

Figure 23:
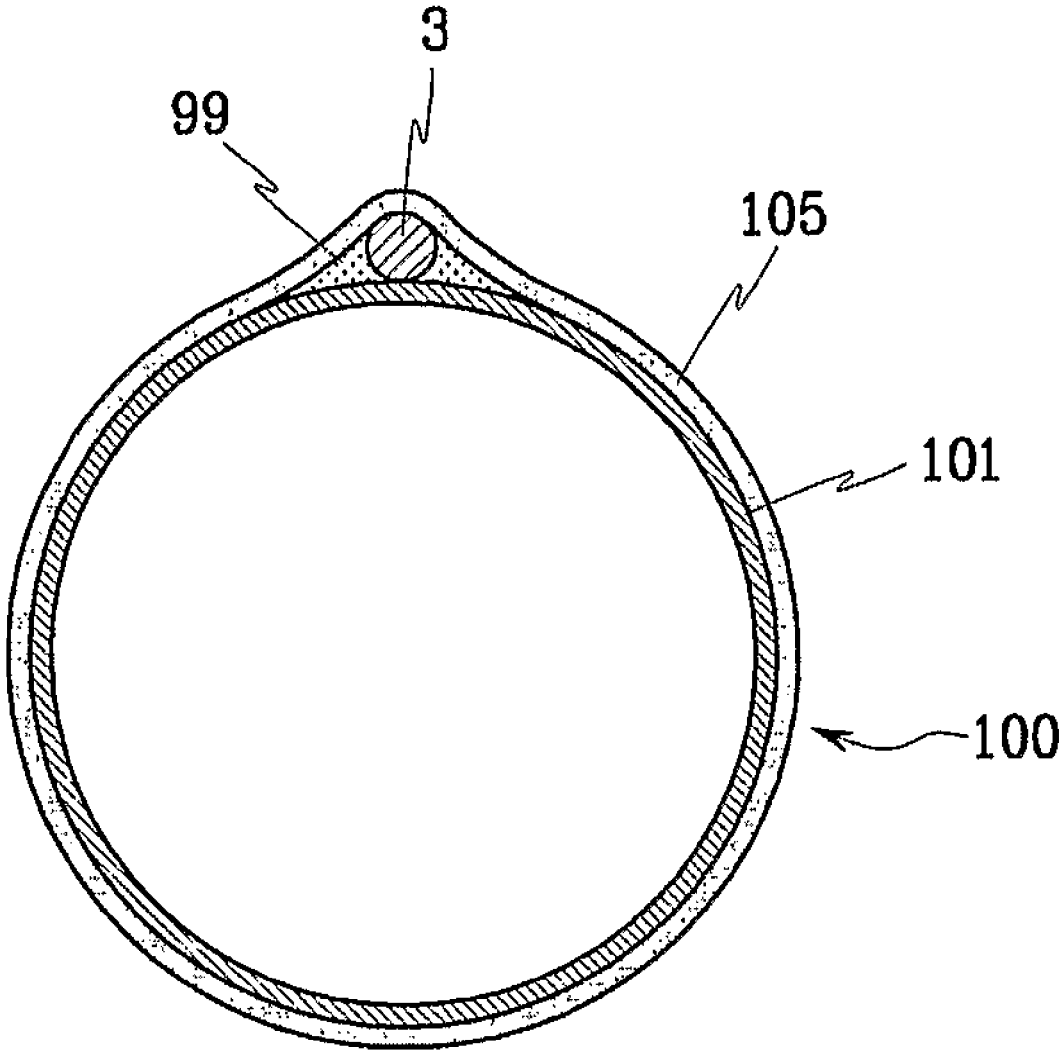
FIG. 23, FIG. 24, FIG. 25, FIG. 26, FIG. 27, FIG. 28, FIG. 29, FIG. 30, and FIG. 31 are respectively cross-sectional views of golf club shafts according to tenth, eleventh, twelfth, thirteenth, fourteenth, fifteenth, sixteenth, seventeenth, and eighteenth exemplary embodiments of the present invention, the cross-section being taken perpendicular to the length direction of the shaft.
Figure 24:
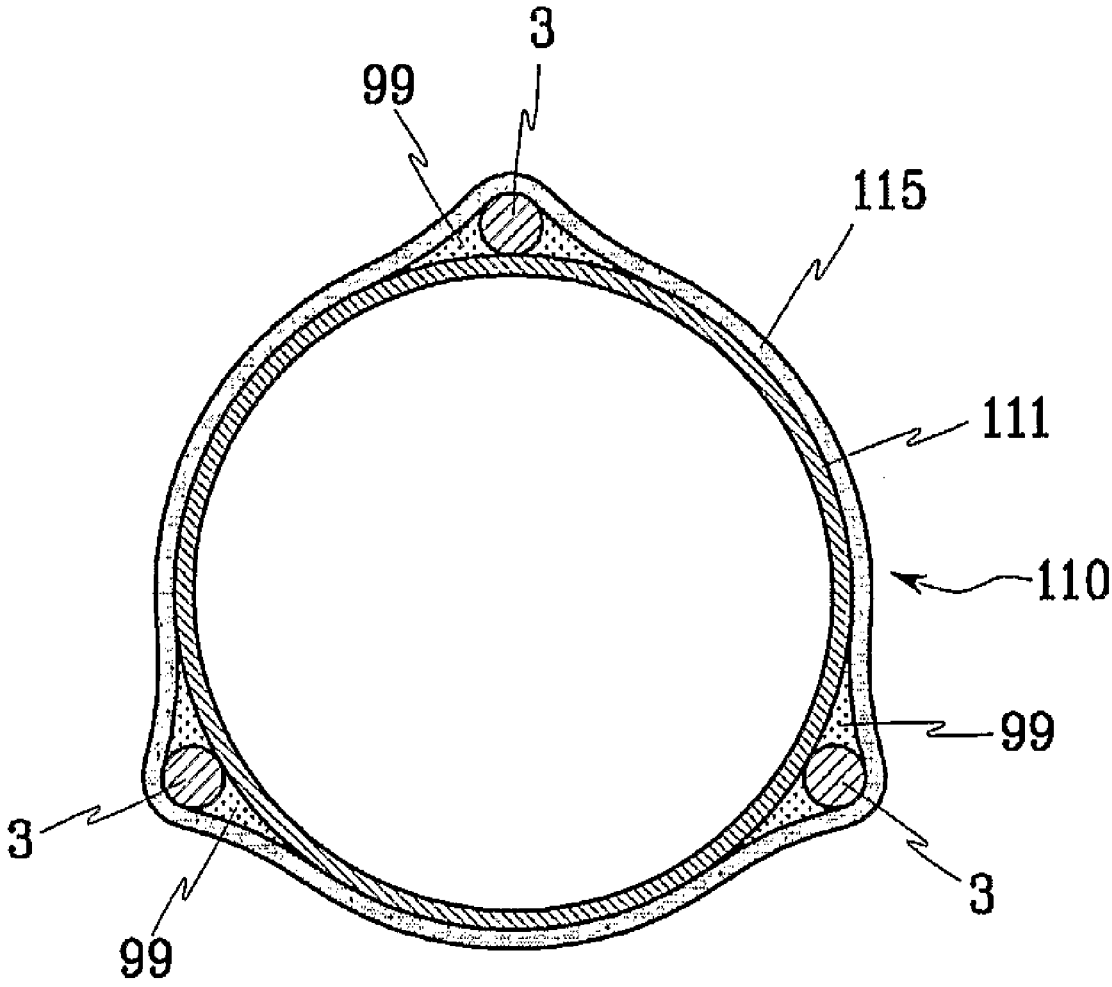
Figure 25:
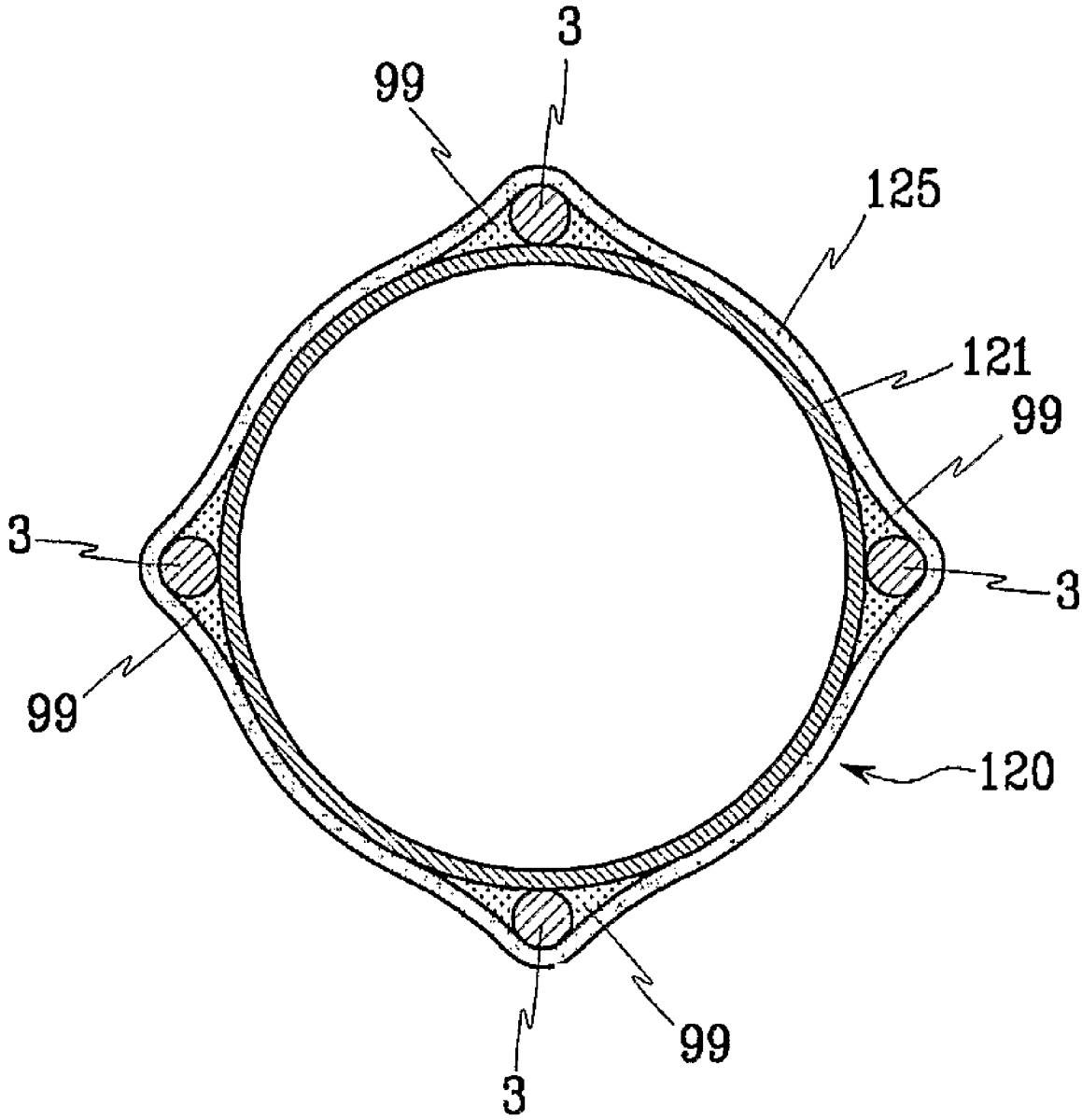
Figure 26:
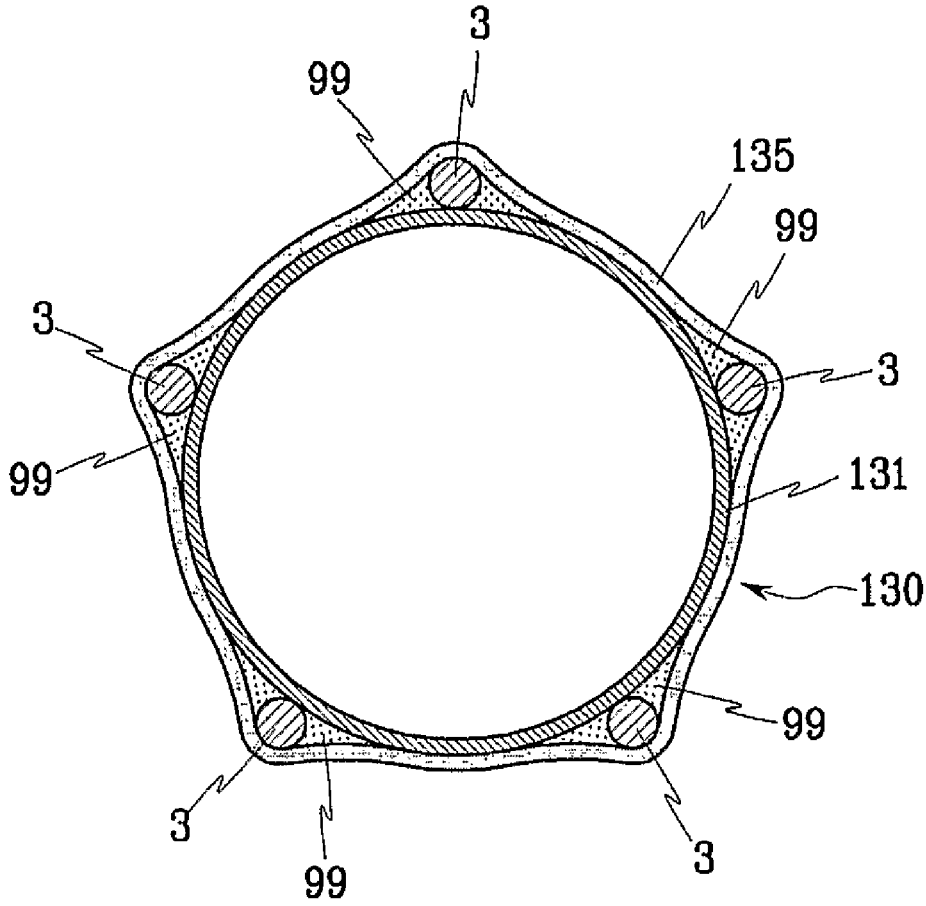

That is, one elastic member 3 is disposed between first and second shell portions 101 and 105 in the shaft 100 of the tenth exemplary embodiment shown in FIG. 23, and three elastic members 3 are disposed between first and second shell portions 111 and 115 in the shaft 110 of the eleventh exemplary embodiment shown in FIG. 24. In addition, four elastic members 3 are disposed between first and second shell portions 121 and 125 in the shaft 120 of the twelfth exemplary embodiment shown in FIG. 25, and five elastic members 3 are disposed between first and second shell portions 131 and 135 in the shaft 130 of the thirteenth exemplary embodiment shown in FIG. 26.

That is, although two elastic members 3 are symmetrically disposed in the ninth exemplary embodiment of the present invention, the scope of the present invention is not limited thereto. On the contrary, the number of the elastic members 3 may vary within the spirit of the present invention.

FIG. 27, FIG. 28, FIG. 29, FIG. 30, and FIG. 31 are respectively cross-sectional views of golf club shafts 140, 150, 160, 170, and 180 according to fourteenth, fifteenth, sixteenth, seventeenth, and eighteenth exemplary embodiments of the present invention, and they show that the diameter as well as the number of the elastic members 3 may vary within the spirit of the present invention.

Figure 27:
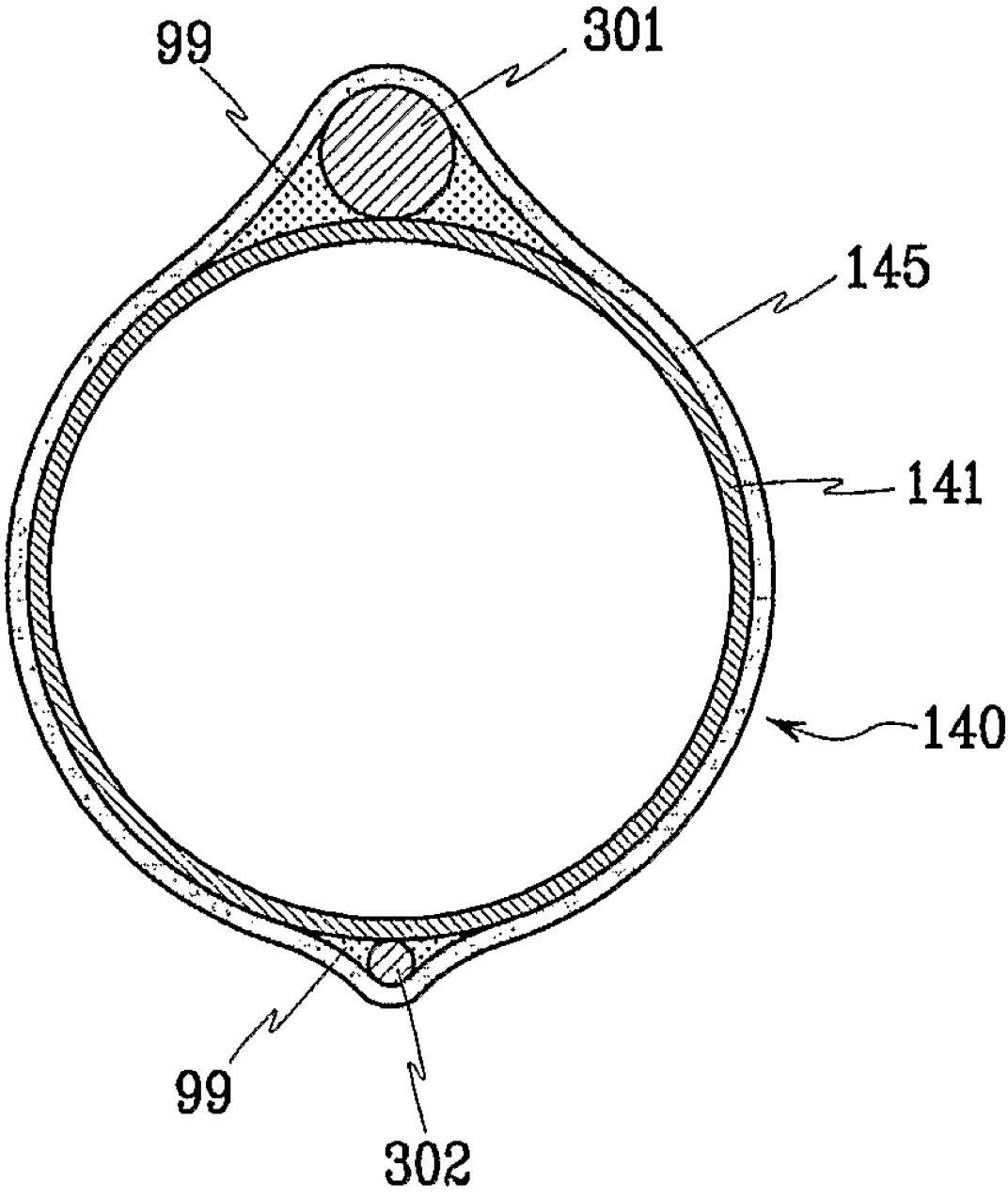

That is, two elastic members 301 and 302 are provided in the shaft 140 of the fourteenth exemplary embodiment shown in FIG. 27. The elastic members 301 and 302 are disposed along a length direction of and at opposite sides of the shaft 140, and they have different diameters.

Figure 28:
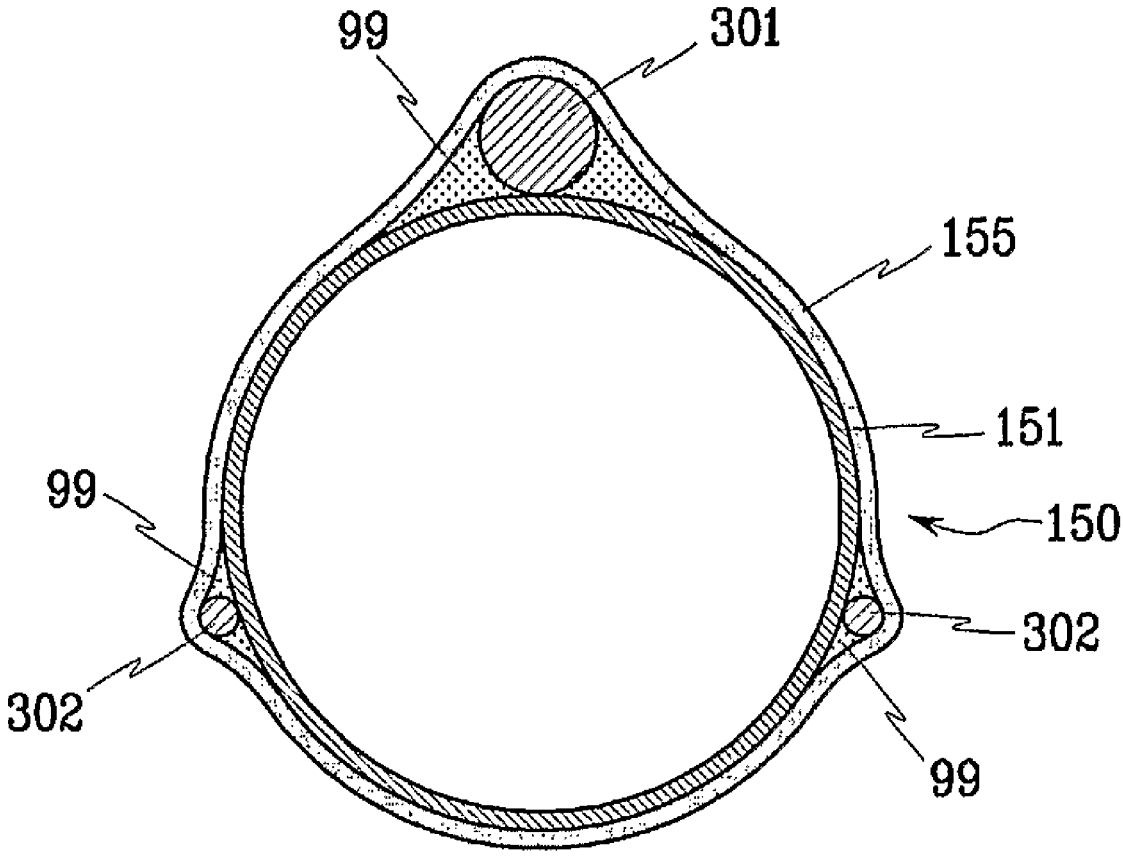

In addition, three elastic members 301 and 302 are provided in the shaft 150 of the fifteenth exemplary embodiment shown in FIG. 28. One elastic member 301 of the elastic members 301 and 302 has a diameter different from that of two elastic members 302.

Figure 29:
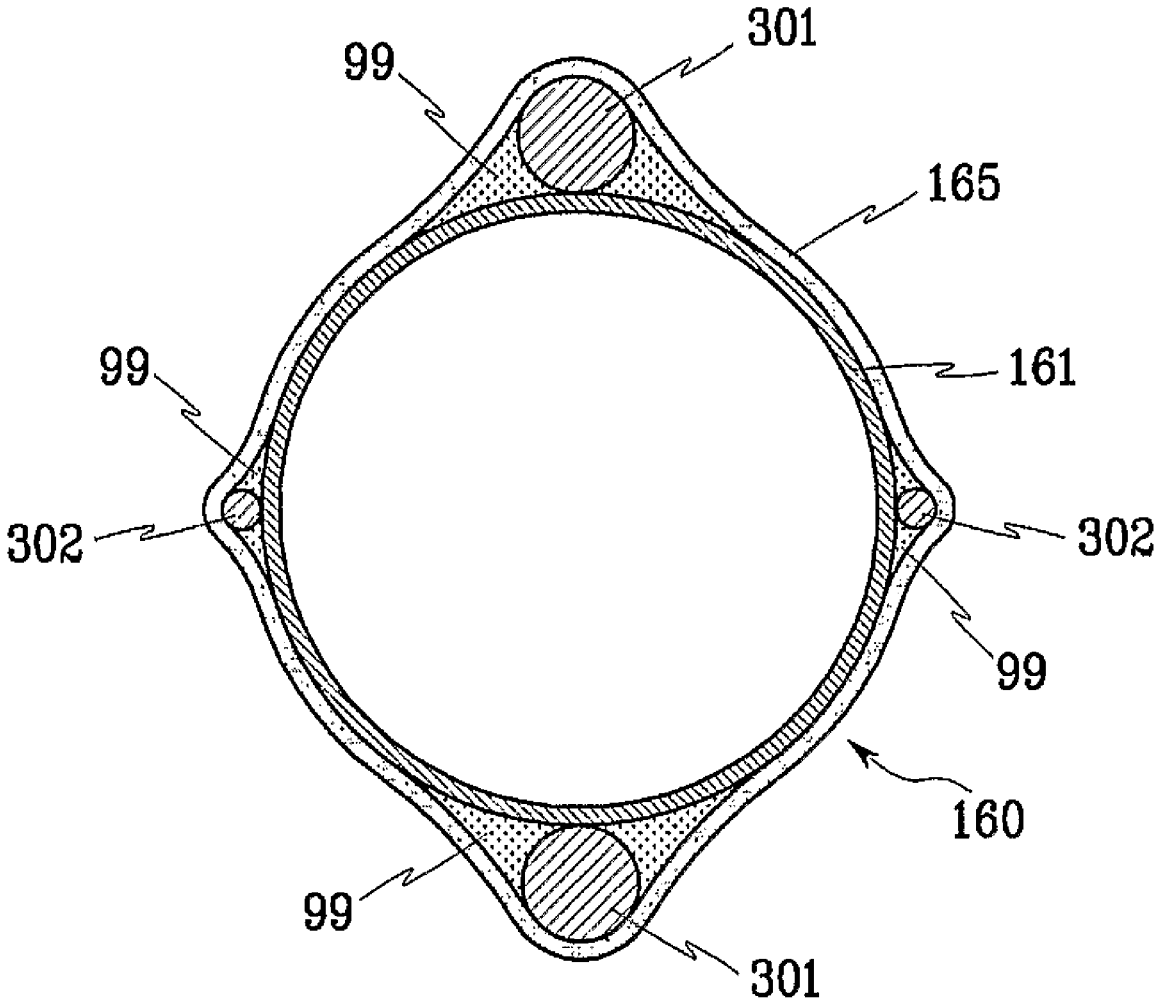

In addition, four elastic members 301 and 302 are provided in the shaft 160 of the sixteenth exemplary embodiment shown in FIG. 29. Two elastic members 301 with the same diameter are disposed opposite to each other across the shaft 160, and two elastic members 302 with the same diameter that is different from the diameter of the two elastic members 301 are disposed opposite to each other across the shaft 160. The elastic members 301 and 302 are alternately disposed such that adjacent elastic members 301 and 302 may have different diameters.

Figure 30:
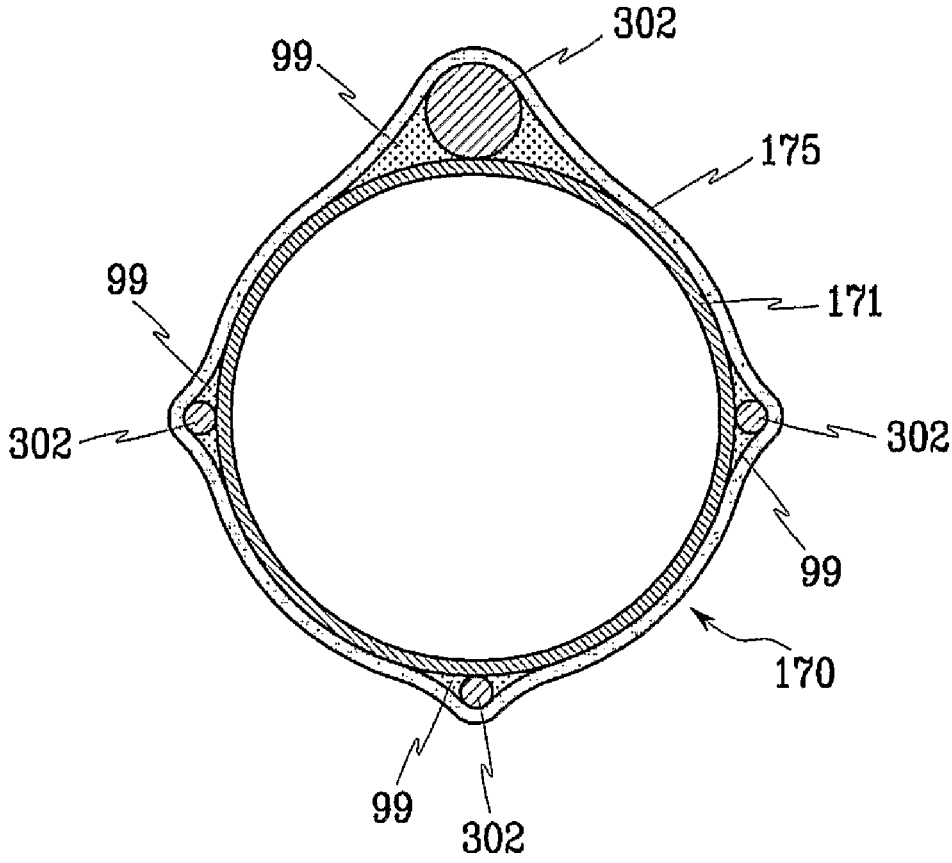

In addition, four elastic members 301 and 302 are provided in the shaft 170 of the seventeenth exemplary embodiment shown in FIG. 30. One elastic member 301 of the elastic members 301 and 302 is formed with a larger diameter than that of the remaining three elastic members 302.

Figure 31:
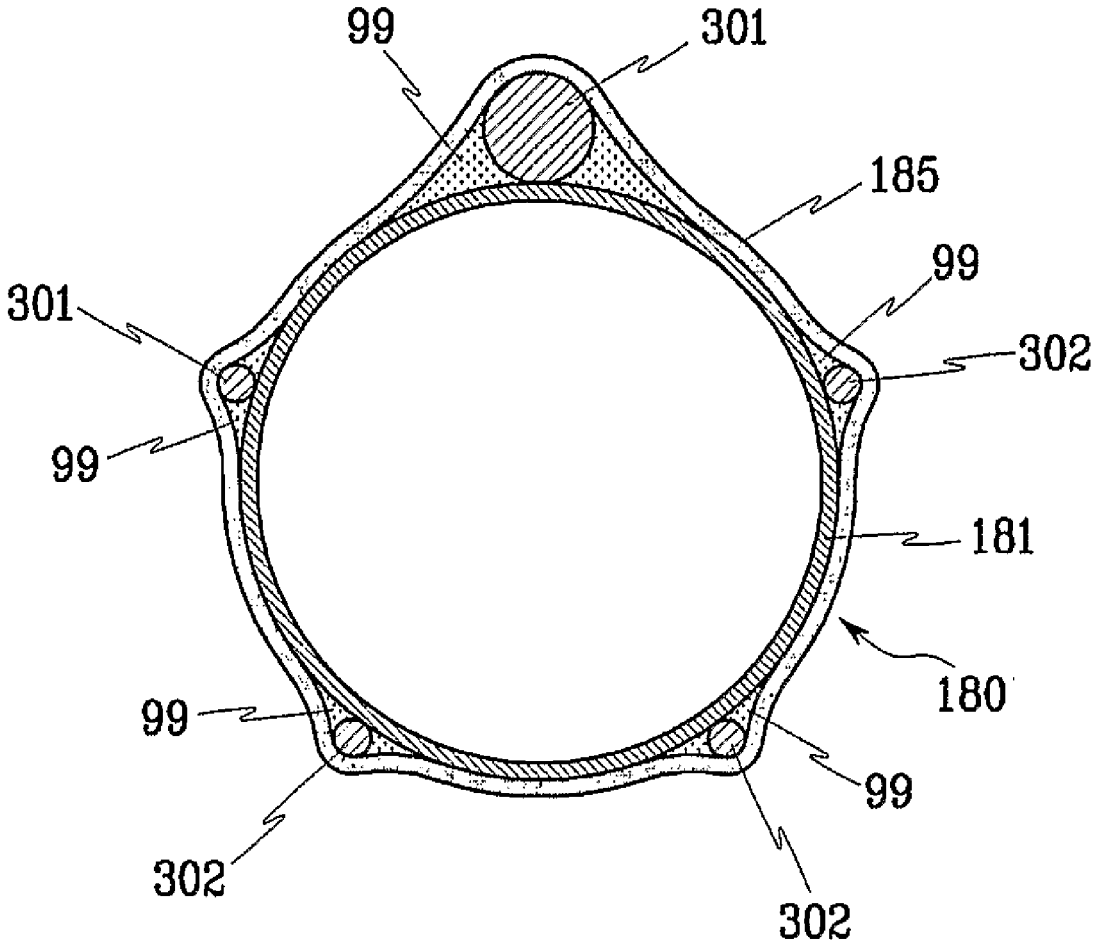

In addition, five elastic members 301 and 302 are provided in the shaft 180 of the eighteenth exemplary embodiment shown in FIG. 31. One elastic member 301 of the elastic members 301 and 302 is formed with larger diameter than that of the remaining four elastic members 302.

As described above, according to an exemplary embodiment of the present invention, at least one elastic member is employed in a length direction of a golf club shaft. Therefore, torque and twist of a golf club shaft is reduced such that a golf ball may be precisely hit so as to be driven in a desired direction. Furthermore, since the restoring force and strength of the shaft is increased, a ball drive distance may accordingly be increased and a precise impact may be achieved.

In addition, since the elastic member reinforces the strength of the shaft, a life of the golf club shaft may be increased.

Further, since the increased elastic force of the elastic member absorbs shocks produced by the impact of the golf club head with the golf ball, shocks delivered to shoulders of the golfer are reduced and the golfer may be protected from injury.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope of the appended claims. Throughout this specification and the claims which follow, unless explicitly described to the contrary, the word "comprise" or variations such as "comprises" or "comprising" will be understood to imply the inclusion of stated elements but not the exclusion of any other elements.

What is claimed is:

1. A golf club shaft, the shaft comprising:

a first shell having at least one groove portion formed therein in a length direction of the shaft;

at least one elastic member disposed at the at least one groove portion; and a second shell enclosing the first shell and the at least one elastic member;

wherein the second shell radially protrudes by a predetermined height at a place where the elastic member is disposed in comparison with a place where the elastic member is not disposed.

2. The golf club shaft of claim 1, wherein the first shell is formed by at least one layer of carbon fiber fabric.

3. The golf club shaft of claim 1, wherein the at least one elastic member comprises at least one of metal and carbon having a predetermined elasticity.

4. The golf club shaft of claim 1, wherein:

the at least one elastic member is formed of metal having a predetermined elasticity; and the metal comprises steel or titanium as a main component.

5. The golf club shaft of claim 1, wherein the second shell is formed by at least one layer of carbon fiber fabric.

6. The golf club shaft of claim 1, wherein the first and second shell are respectively formed by at least one layer of carbon fiber fabric; and the at least one elastic member comprises at least one of metal and carbon having a predetermined elasticity.

7. A golf club shaft, the shaft comprising:

a first shell comprising carbon and interiorly disposed in the shaft;

at least one elastic member disposed in a length direction on an exterior circumference of the first shell; and a second shell comprising carbon and enclosing the first shell and the at least one elastic member;

wherein the second shell radially protrudes by a predetermined height at a place where the elastic member is disposed in comparison with a place where the elastic member is not disposed.

8. The golf club shaft of claim 7, wherein the first shell is formed by at least one layer of carbon fiber fabric.

9. The golf club shaft of claim 7, wherein the at least one elastic member comprises at least one of carbon and metal having a predetermined elasticity.

10. The golf club shaft of claim 7, wherein:

the at least one elastic member is formed of metal having a predetermined elasticity; and the metal comprises steel or titanium as a main component.

11. The golf club shaft of claim 7, wherein the second shell is formed by at least one layer of carbon fiber fabric.

12. The golf club shaft of claim 7, wherein the at least one elastic member is disposed between kick-points or between a grip and a kick-point.

* * * * *